US006651276B2

(12) United States Patent
McCraw et al.

(10) Patent No.: US 6,651,276 B2
(45) Date of Patent: Nov. 25, 2003

(54) FLOATING SLAT FRAME FOR A MATTRESS FOUNDATION

(75) Inventors: Kevin N. McCraw, Burnsville, NC (US); James J. Bush, Hickory, NC (US); R. Stuart Spiller, Jr., Oostburg, WI (US)

(73) Assignee: Hickory Springs Manufacturing Company, Hickory, NC (US)

( * ) Notice: Subject to any disclaimer, the term of this patent is extended or adjusted under 35 U.S.C. 154(b) by 0 days.

(21) Appl. No.: 09/927,706

(22) Filed: Aug. 10, 2001

(65) Prior Publication Data

US 2003/0028963 A1 Feb. 13, 2003

(51) Int. Cl.[7] ..... A47C 23/02
(52) U.S. Cl. ..... 5/246; 5/236.1; 5/241
(58) Field of Search ..... 5/246, 131, 252, 5/236.1, 263, 264.1, 309, 400, 241, 239, 244; 52/403.1

(56) References Cited

U.S. PATENT DOCUMENTS

| | | | | | |
|---|---|---|---|---|---|
| 62,395 | A | | 2/1867 | Coats | |
| 67,362 | A | | 7/1867 | Small | |
| 93,632 | A | | 8/1869 | McBride et al. | |
| 95,329 | A | | 9/1869 | Decamp | |
| 99,056 | A | | 1/1870 | Briggs | |
| 104,048 | A | * | 6/1870 | McArthur | 5/239 |
| 123,046 | A | | 1/1872 | Power | |
| 135,885 | A | * | 2/1873 | Bush | 5/239 |
| 159,930 | A | | 2/1875 | Jones | |
| 162,096 | A | | 4/1875 | Owens et al. | |
| 169,615 | A | | 11/1875 | Bartlett | |
| 268,071 | A | | 11/1882 | Benedict | |
| 1,019,510 | A | * | 3/1912 | Mesta | 5/230 |
| 1,808,679 | A | | 6/1931 | Piccolini | |
| 3,958,284 | A | | 5/1976 | Jureit et al. | 5/200 |
| 4,100,631 | A | * | 7/1978 | Slone | 2/263 |
| 4,181,991 | A | | 1/1980 | Morgan et al. | 5/400 |
| 4,377,279 | A | | 3/1983 | Schulz et al. | 267/103 |
| 4,584,727 | A | * | 4/1986 | Reiss et al. | 5/13 |
| 4,685,658 | A | * | 8/1987 | Keown | 267/103 |
| 5,052,064 | A | | 10/1991 | Hagemeister et al. | 5/246 |
| 5,459,892 | A | * | 10/1995 | Wells et al. | 5/200.1 |
| 5,485,640 | A | | 1/1996 | Workman | 5/263 |
| 5,553,338 | A | | 9/1996 | Amann | |
| 5,967,499 | A | | 10/1999 | McCraw et al. | 267/103 |
| 6,003,178 | A | | 12/1999 | Montoni | 5/690 |

* cited by examiner

*Primary Examiner*—Heather Shackelford
*Assistant Examiner*—Lisa M. Saldano
(74) *Attorney, Agent, or Firm*—David M. Thimmig; Mayer, Brown, Rowe & Maw

(57) ABSTRACT

A floating slat frame adapted to provide additional flexibility within mattress foundations of various configurations. The floating slat frame is constructed for attachment to a core assembly, and has a series of slats in a first plane, at least some of which are resiliently supported relative to a second series of slats in a second plane.

23 Claims, 19 Drawing Sheets

FLOATING SLAT FRAME FOR A MATTRESS FOUNDATION

BACKGROUND OF THE INVENTION

1. Field of the Invention

The present invention generally relates to frames used as a base within mattress foundations, and more particularly to floating slat frames adapted to provide additional flexibility within mattress foundations of various configurations.

2. Discussion of the Prior Art

Early prior art bedding structures often included springs incorporated into a bed frame to resiliently support a user above a floor surface directly, or in combination with an upper mattress. Examples of such structures are shown in U.S. Pat. Nos. 93,632; 159,930; 162,096; and 169,615. In other embodiments, such as shown in U.S. Pat. Nos. 67,362; 95,329; 99,056; 123,046; 268,071; and 1,808,679, springs or other resilient members were used within bed bottom or mattress structures to separate a bottom plane, intended to be held by a bed frame, from a top plane, intended to support a user either directly or in combination with an upper mattress.

More modern bedding structures commonly have separate bedding components which together form a complementary system having an upper mattress resting on top of a mattress foundation, which in turn is held above a floor surface by a bed frame. Three of the most common types of upper mattresses are an inner spring mattress typically having a plurality of wire coil modules arranged in an rectangular array and defining top and bottom planes; a foam core mattress having one or more layers of foam defining top and bottom planes; and a fluid filled mattress such as a waterbed or air mattress. The mattress foundation may include a relatively rigid or resilient core assembly, and sometimes may be referred to as a "box spring" in the trade. Contrary to some early bedding structures, both mattress foundations and mattresses now typically include a top padding and fabric covering to provide an upholstered finish. In regard to the underlying bed frame, it may be a simple metal frame structure to hold a mattress foundation, and hence an overlying mattress, above a floor surface, or may be a more elaborate piece of furniture having structure adapted to hold a mattress foundation, and an overlying mattress above a floor surface.

Of particular interest, modem mattress foundations tend to have a fairly standard rigid base constructed of a plurality of wood or metal slats fixedly connected to each other. An example of such a conventional prior art base in the form of a slat frame 1 is shown in FIG. 1. The slat frame would typically be constructed of wood pieces nailed or stapled together to form a relatively rigid base. As shown in the prior art of FIG. 1, the slat frame is comprised of a series of laterally spaced slats 2 that are attached or connected to a series of longitudinally spaced slats 4. Lateral end slats 6 and lateral filler slats 8 form the ends of the slat frame. In this regard, for purposes of explanation only, the term "longitudinal" will be used when speaking of the head-to-toe direction of any portion of a mattress foundation. In turn, the complementary term "lateral" will be used when addressing the side-to-side direction of any portion of a mattress foundation. The base would be sized to engage a corresponding standard bed frame. The base provides a structure to which one can fasten an upper core assembly to accept the load from above and to obtain the spacing between the top and bottom plane of the mattress foundation.

In some foundations, such as shown in U.S. Pat. Nos. 5,052,064 and 4,377,279, the additional core assembly mounted on the slat frame base is relatively rigid and may be constructed of bent wire. However, relatively rigid core assemblies may be of many different configurations and may be made of various materials, such as wire, wood, plastic, or the like. In other mattress foundations, such as shown in U.S. Pat. Nos. 4,921,228 and 4,730,358, and which also may be known as box springs, the core assembly is intended to be resilient and may be constructed of bent or coiled wire. As with the relatively rigid core assemblies, resilient core assemblies may be constructed in many different ways and of various materials, such as wire, plastic, foam, or the like. In any event, the core and base are typically covered in padding and fabric in the final mattress foundation.

Hence, it has become common for mattress foundations to incorporate a slat frame as a base. These slat frames typically consist of a plurality of wood and/or metal slats fixed in a crossed relationship to each other, as generally shown in FIG. 1. The slat frames are used to carry a core assembly, to ultimately distribute the bedding load to the bed frame, and to provide relatively rigid or resilient spacing of the mattress from the bed frame.

Manufacturers have tended to focus on the structure and performance of wire or wood core assemblies atop common rigid slat frames. Indeed, the prior art contains many developments relating to tuning the comfort, durability or other performance characteristics, or to reduce cost or complexity of mattress foundation core assemblies. However, although numerous prior art core assemblies for attachment to common bases exist, manufacturers have generated little thought or innovation with respect to the slat frames themselves.

In a mattress foundation using a relatively rigid core assembly atop a slat frame, it is undesirable, yet may be common, to encounter a hard downward stop when pressure is applied to an overlying mattress. Nevertheless, prior to the present invention, in mattress foundations where manufacturers wished to avoid such a hard stop, the core assembly had to be designed to provide resilience independent of the slat frame itself. Thus, it is desirable to provide a slat frame that, when used in conjunction with a relatively rigid core assembly, is capable of providing some resilience while still providing a relatively rigid structure for engaging a bed frame. Such a structure would permit the relatively rigid core assemblies to flex under pressure, thereby offering a more resilient mattress foundation without need to design resilience into the core assembly.

Even with mattress foundations that incorporate a resilient core assembly atop a slat frame, it is desirable that the slat frame have some resilience to permit further tuning of the performance characteristics of the foundation.

Also, it is desirable to be able to isolate movement within the mattress foundation in correspondence with the location of the pressure applied. This is most easily appreciated in reference to isolating the respective deflection present across the width of a mattress foundation when used in conjunction with an upper mattress that accommodates two or more people.

It is further advantageous to be able to provide different levels of resilience at different locations within a mattress foundation. For instance, it may be desirable for a mattress foundation to be relatively rigid along the sides while being more resilient at the ends and in the central portion of the foundation. Or, for example, a manufacturer may wish for a mattress foundation to be relatively rigid at the ends and more resilient along the sides and in the central portion.

It also is desirable to be able to use a common relatively rigid or resilient core assembly with various slat frames to produce different products. For instance, rather than having to retool to manufacture core assemblies of different heights to be able to offer thicker mattress foundations, manufacturers may use the same core assembly on a standard base frame and on a floating slat frame to achieve different mattress foundation thicknesses, as well as different levels of resilience.

The present invention overcomes the disadvantages of the rigid bases found in the prior art, while providing the above mentioned desirable features of floating slat frames for mattress foundations. Other features and advantages of the present invention will become apparent to those of skill in the art upon considering the remainder of this disclosure, including the detailed description of the preferred embodiments, the drawings and the claims.

SUMMARY OF THE INVENTION

The purpose and advantages of the invention will be set forth in and apparent from the description and drawings that follow, as well as will be learned by practice of the invention.

The present invention is generally embodied in an improved slat frame which can be configured in a variety of ways for use in mattress foundations. The floating slat frame comprises a first plurality of spaced apart slats arranged in a first direction and in a first plane and at least a second plurality of spaced apart slats arranged in a second direction and in a second plane, the second direction being at an angle to the first direction and the second plane being spaced from the first plane. The floating slat frame further has at least one resilient support disposed between and engaging at least one of the slats of the first plurality of slats and at least one of the slats of the second plurality of slats.

In a further aspect of the invention, a floating slat frame may be used in combination with at least one core assembly for use in a mattress foundation. The floating slat frame comprising a first plurality of spaced apart slats arranged in a first direction and in a first plane and at least a second plurality of spaced apart slats arranged in a second direction and in a second plane, the second direction being at an angle to the first direction and the second plane being spaced from the first plane. The floating slat frame further having at least one resilient support disposed between and engaging at least one of the slats of the first plurality of slats and at least one of the slats of the second plurality of slats. The core assembly comprising a rectangular top structure, a plurality of support modules attached at an upper end to the rectangular top structure and attached at a lower end to the floating slat frame.

In another aspect of the invention, a method of providing resilient support in a mattress foundation base frame is provided, wherein the method comprises the steps of providing in a first plane and in a first direction a first series of spaced apart slats having an upper surface, providing in a second plane spaced from the first plane and in a second direction at an angle to the first direction a second series of spaced apart slats having a lower surface, providing at least one slat engaging at least the upper surface of a plurality of slats of the first series, and providing at least one resilient support disposed between and engaging at least the upper surface of at least one slat of the first series and at least the lower surface of at least one slat of the second series.

It is to be understood that both the foregoing general description and the following detailed description are exemplary and provided for purposes of explanation only, and are not restrictive of in the invention, as claimed. Further features and objects of the present invention will become more fully apparent in the following description of the preferred embodiments of this invention and from the appended claims.

BRIEF DESCRIPTION OF THE DRAWINGS

In describing the preferred embodiments, reference is made to the accompanying drawings wherein like parts have like reference numerals, and wherein.

It should be understood that the drawings are not to scale and that certain aspects are simplified to avoid the confusion of lines that are unnecessary to illustrate the invention. While certain mechanical details of a floating slat frame, including some details of fastening means and other plan and section views of the particular exemplary embodiments depicting the invention and components which may be employed in practicing the invention have been omitted, such detail is considered well within the comprehension of those skilled in the art in light of the present disclosure. It also should be understood that the present invention is not limited to the embodiments illustrated.

DETAILED DESCRIPTION OF THE PREFERRED EMBODIMENTS

Referring generally to FIGS. 2–21, it will be appreciated that the present invention may be embodied in numerous configurations of a floating slat frame for use in mattress foundations. FIGS. 2–9 provide examples of floating slat frames. FIGS. 10–15 illustrate examples of floating slat frames in combination with core assemblies. FIGS. 16–21 present examples of resilient supports for use in floating slat frames.

Figure 2:
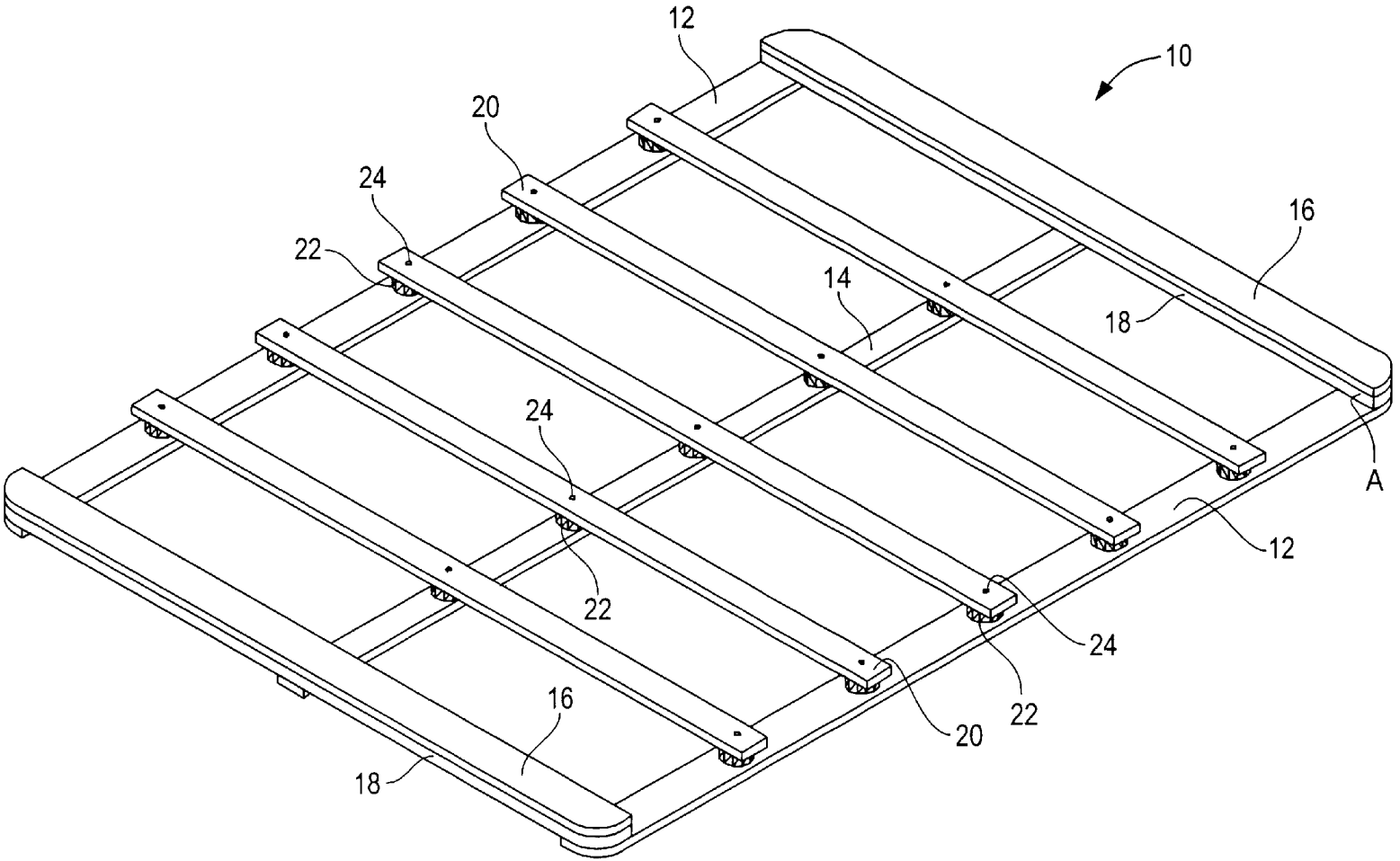
FIG. 2 is a perspective view of a floating slat frame having relatively rigid ends.

FIG. 2 depicts a floating slat frame 10 constructed with a number of slats, including longitudinal side slats 12 and longitudinal central slat 14, together with lateral end slats 16, 18 and lateral central slats 20. Any one or more of the slats may be relatively rigid or flexible, or a combination of both to tailor the resilience in the floating slat frame 10. Accordingly, the slats may have various cross sections and be made of any suitable material, such as wood, metal, plastic, or the like. Also, a single floating slat frame may have any desired number of longitudinal and lateral slats. Thus, in some configurations, floating slat frame 10 may have no longitudinal central slat or may have multiple longitudinal central slats, and correspondingly may have additional or fewer lateral central slats.

Slat frame 10 of FIG. 2 is constructed with a first set of relatively rigid lateral end slats 16 overlapping a second set of relatively rigid lateral end slats 18 to selectively provide a frame for use in a mattress foundation intended to have greater rigidity at its ends. Lateral end slats 16, 18 may be fixedly connected to each other and to longitudinal side slats 12 in any suitable manner, such as by mechanical fasteners, adhesives, or the like. Although FIG. 2 depicts the ends of the longitudinal side slats 12 as positioned below the corresponding ends of the lateral end slats 18, one should appreciate that depending on the type of fasteners used to join the slats, the ends of longitudinal side slats 12 may abut the interior edges of end slats 18, in the location generally denoted as A in FIG. 2. Then, to provide the floating nature or more resilient feel of the slat frame 10 along the sides and in the central portion of the mattress foundation, lateral central slats 20 are spaced apart from longitudinal side slats 12 and longitudinal central slat 14 by resilient supports 22.

Resilient supports 22 may be made of various materials and may be formed in many configurations, some examples of which are depicted in FIGS. 16–21 and will be discussed in further detail below. However, to simplify the present explanation, it will be sufficient to note that in the exemplary embodiment of FIG. 2, resilient supports 22 are generally depicted as cylindrical pads, and are used in conjunction with fasteners 24. Fasteners 24 each have a head, and a stem which slidingly passes through a slat 20 and pad 22 and which is fixedly engaged to an underlying longitudinal side slat 12 or longitudinal central slat 14. Thus, fasteners 24 permit lateral slats 20 to move vertically at each fastener 24 relative to longitudinal side slats 12 and longitudinal central slat 14, while prohibiting horizontal movement and complete separation of the slats from each other. As shown in this embodiment, fasteners 24 may be mechanical fasteners, such as screws, nails, rivets, or the like. In addition, it will be appreciated that one or more of the fasteners 24 could be selectively omitted in favor of using adhesives, or the like, to attach the supports 22 to the respective slats.

Figure 1:
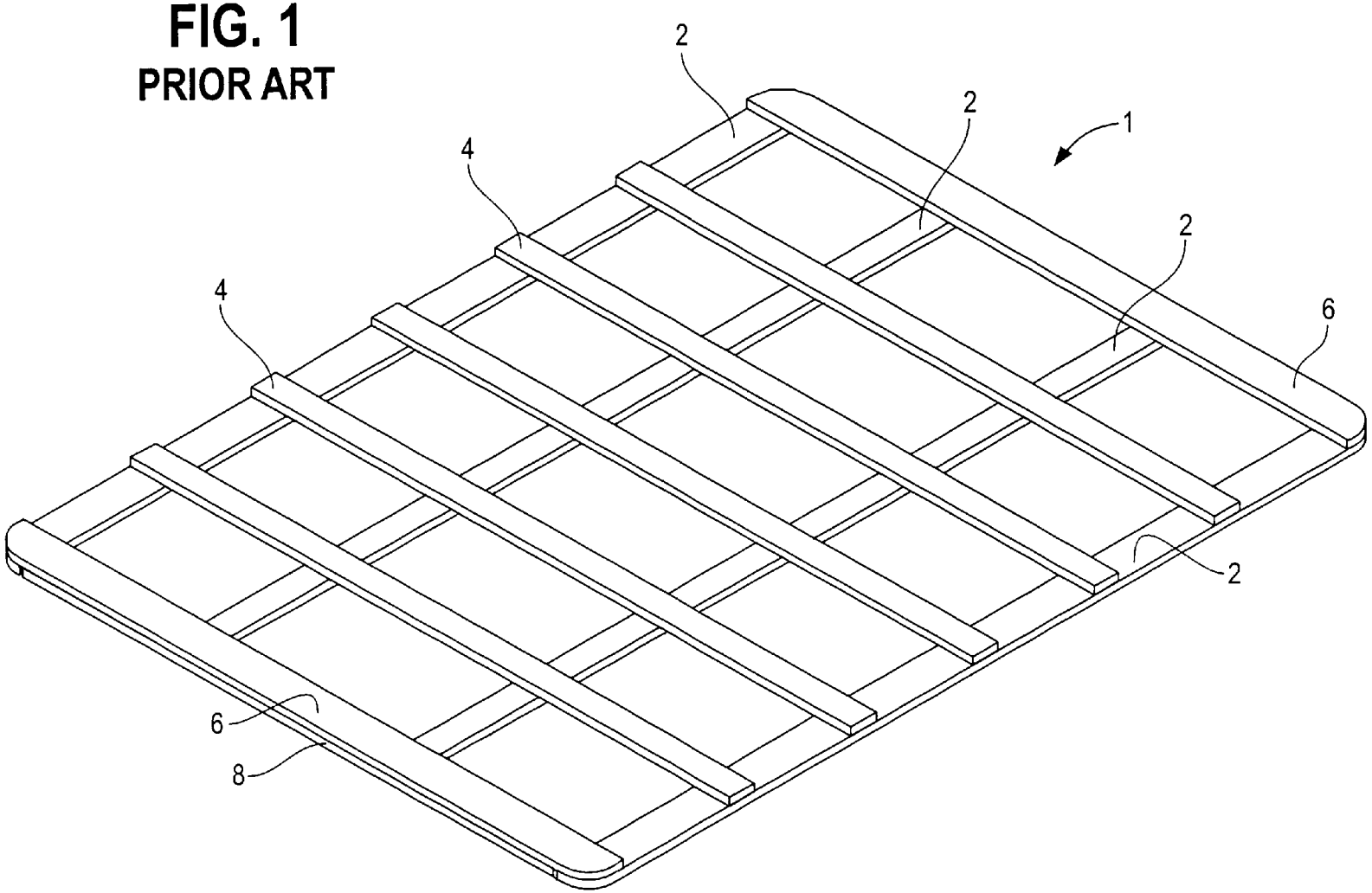
FIG. 1 PRIOR ART
FIG. 1 is a perspective view of an example of a prior art relatively rigid slat frame typically used as a base in mattress foundations.

Hence, while FIG. 1 is an example of a prior art standard slat frame that is essentially rigid, the above described embodiment of FIG. 2 provides a floating slat frame 10 that is selectively constructed to offer resilience along the sides and in the central portion of the frame. In conjunction with the remainder of a mattress foundation, the resilience in the embodiment of FIG. 2 will reduce the feel of an overlying mattress (not shown) bottoming out in those areas. The frame 10 is further selectively constructed to be relatively rigid for receipt in a bed frame (not shown).

Figure 3:
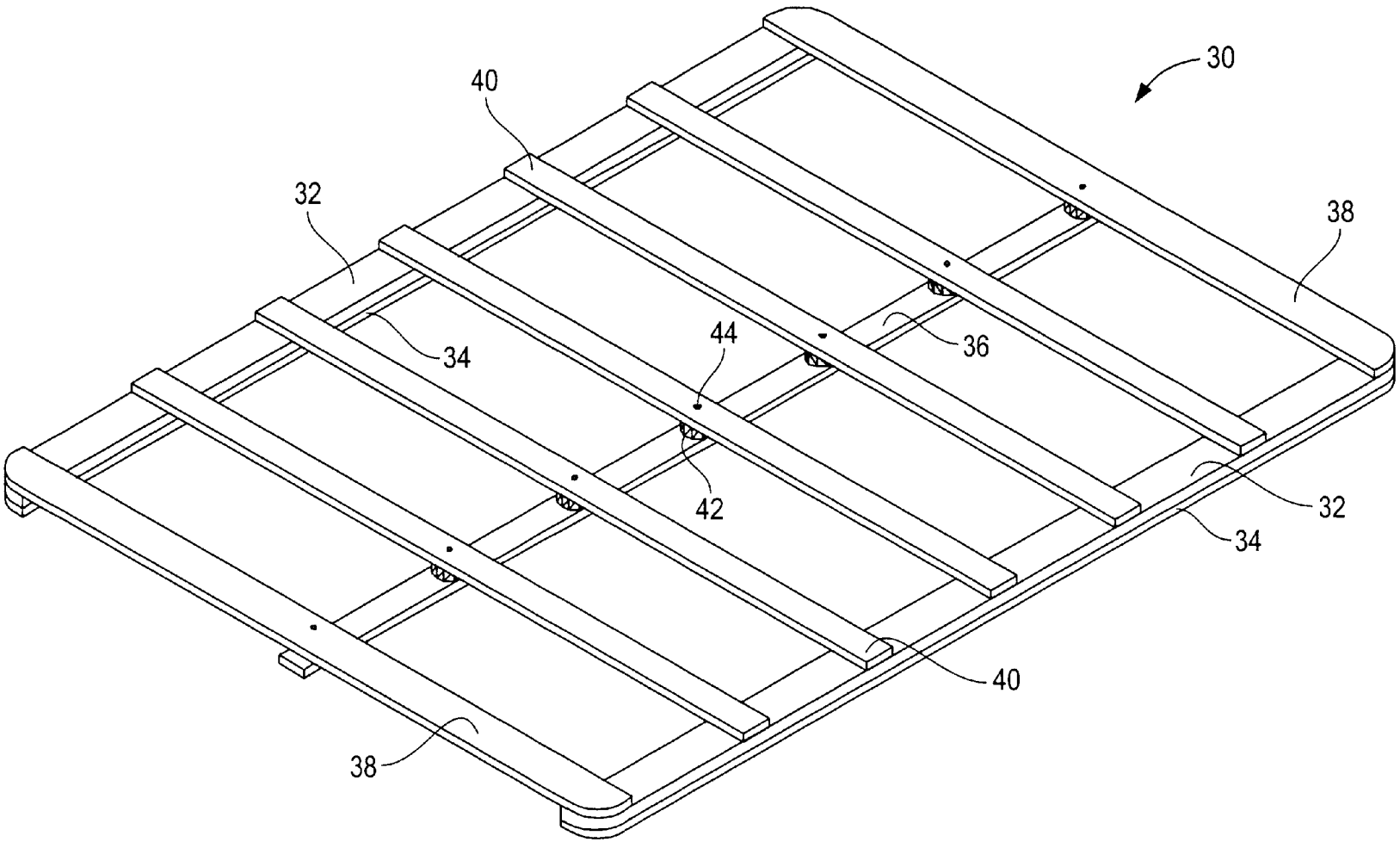
FIG. 3 is a perspective view of an alternative embodiment of a floating slat frame having relatively rigid sides.

Turning to FIG. 3, an alternative embodiment of a floating slat frame 30 is shown. Floating slat frame 30 includes longitudinal side slats 32, 34 and longitudinal central slat 36, together with lateral end slats 38 and lateral central slats 40. The embodiment of FIG. 3 may be constructed in a manner similar to that of the embodiment of FIG. 2, using resilient supports 42 and fasteners 44 (which may be mechanical fasteners, adhesive, or the like), or in any one of many alternative ways which will become more readily apparent after reviewing the remainder of this detailed description of the preferred embodiments. In floating slat frame 30, a first set of relatively rigid longitudinal side slats 32 overlap and are fixedly attached to a second set of relatively rigid longitudinal side slats 34. In turn, lateral end slats 38 and lateral central slats 40 overlap and are fixedly attached at their ends to longitudinal side slats 32, while being resiliently spaced from longitudinal central slat 36. Given that longitudinal central slat 36 is not rigidly fixed within the same plane as longitudinal side slats 34, it will be appreciated that floating slat frame 30 must be supported by a bed frame having both longitudinal and lateral support rails to give effect to the resilient supports 42 on top of longitudinal central support 36. With the construction of FIG. 3, floating slat frame 30 provides high rigidity along the sides, and some resilience toward the center of the lateral end slats 38 and in the central portion of the frame.

Figure 4:
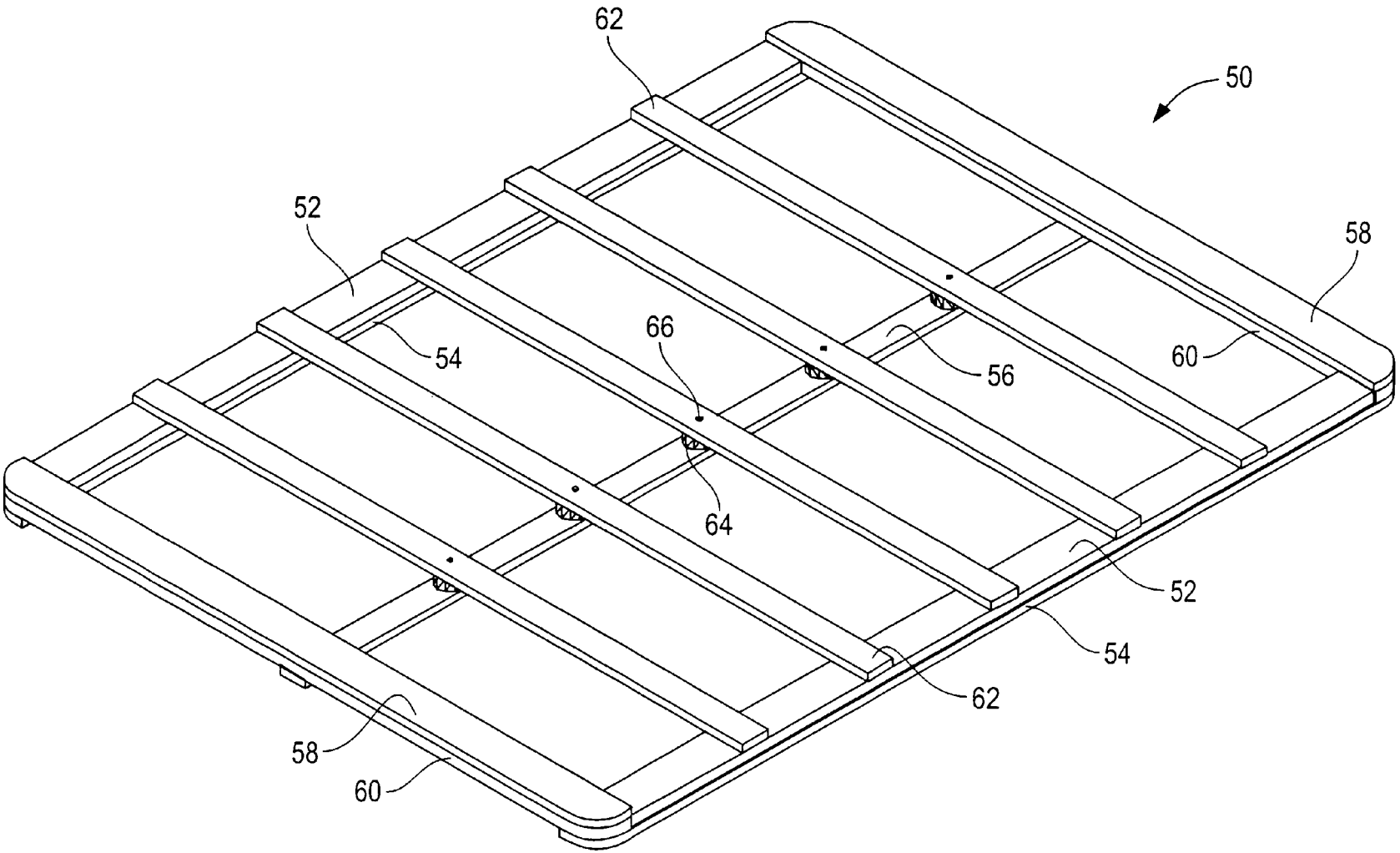
FIG. 4 is a perspective view of an alternative embodiment of a floating slat frame having relatively rigid sides and ends.

Now referring to FIG. 4, a further alternative embodiment of a floating slat frame 50 is shown. Floating slat frame 50 includes longitudinal side slats 52, 54 and longitudinal central slat 56, together with lateral end slats 58, 60 and lateral central slats 62. Again, it will be appreciated that this alternative embodiment may be constructed in a manner similar to that of the embodiment of FIG. 2, with resilient supports 64 and fasteners 66, or in one of many alternative ways.

Floating slat frame 50 provides a relatively rigid base frame around the entire perimeter, i.e., at the ends and along the sides, but a more resilient slat frame in the central portion. This is accomplished by having a first set of relatively rigid longitudinal side slats 52 overlapping and fixedly attached to a second set of relatively rigid longitudinal side slats 54. Also, a first set of relatively rigid lateral end slats 58 overlap and are fixedly attached to a second set of relatively rigid lateral end slats 60. Lateral end slats 60 overlap and are fixedly attached to the ends of longitudinal central slat 56. Finally, lateral central slats 62 overlap and are fixedly attached at their ends to longitudinal side slats 52, while being resiliently spaced from longitudinal central slat 56 by the resilient supports 64 located where lateral central slats 62 cross longitudinal central slat 56.

Thus, when considering FIGS. 3 and 4, the floating slat frame can be tailored to achieve desired resilience at various locations within the frame. Because the frame 30 of FIG. 3 has supports 42 associated with lateral end slats 38, resilience is achieved along the entire longitudinal dimension of longitudinal central slat 36. In FIG. 4, there are no resilient supports 64 associated with lateral end slats 58 and, consequently, there would be little, if any, resilience at the intersection of longitudinal central slat 56 and lateral end slats 58, 60.

Figure 5:
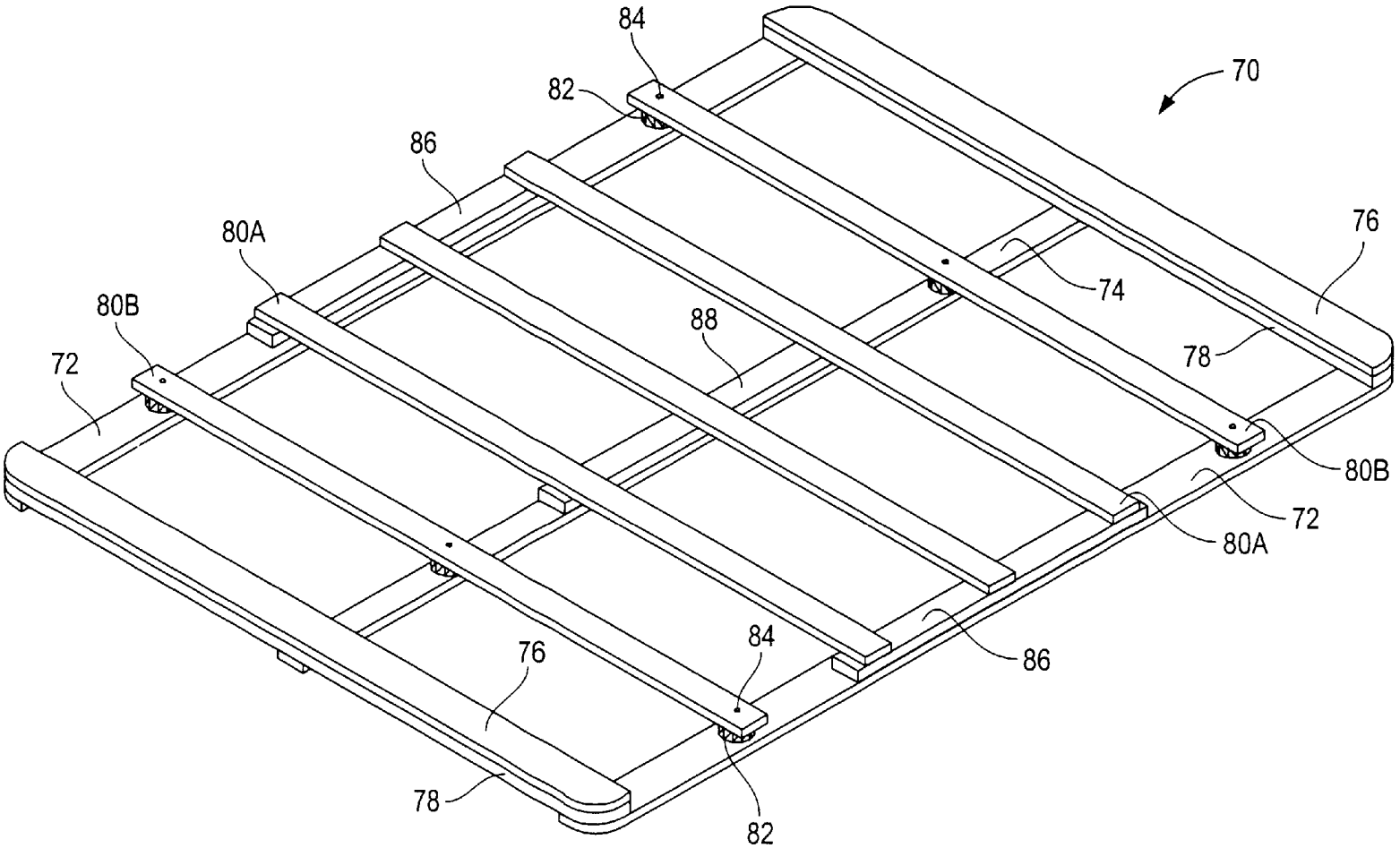
FIG. 5 is a perspective view of an alternative embodiment of a floating slat frame having relatively rigid ends and a relatively rigid central portion.

FIG. 5 provides a further alternative embodiment of a floating slat frame 70 which illustrates that the present invention permits bedding designers to elect to further tune the location and degree of resilience within slat frames for use in mattress foundations. For instance, floating slat frame 70 is constructed with longitudinal side slats 72 and longitudinal central slat 74, as well as lateral end slats 76, 78 and lateral central slats 80A, 80B.

In the embodiment of FIG. 5, a first set of relatively rigid lateral end slats 76 overlap and are fixedly attached to a second set of relatively rigid lateral end slats 78. Lateral end slats 78 overlap and are fixedly attached to the ends of longitudinal central slat 74. Selective resilience is provided in the central portion by having different supports for the three central-most lateral central slats 80A than are provided for the two end-most lateral central slats 80B. For instance, the two end-most lateral slats 80B may overlap and be resiliently spaced at their ends from longitudinal side slats 72, while also overlapping and being resiliently spaced from longitudinal central slat 74. The resilient spacing may be provided in ways similar to those described above, such as with resilient supports 82 and fasteners 84.

With respect to the three central-most lateral central slats 80A additional longitudinal side supports 86 are provided between longitudinal side slats 72 and the ends of the three central-most lateral central slats 80A, while longitudinal central support 88 is provided between longitudinal central slat 74 and the same three central-most lateral central slats 80A. It will be appreciated that the longitudinal side supports 86 and longitudinal central support 88 may be made of relatively rigid material, such as might be used for the longitudinal side slats 72. Alternatively, longitudinal side supports 86 and longitudinal central support 88 may be made of more resilient material, such as would be suitable for resilient supports 82. In this manner, FIG. 5 illustrates that, as opposed to only using individual smaller resilient supports 82 at discrete intersections of longitudinal and lateral slats, such resilient supports 82 may be replaced by an elongated piece of material, or for instance, any number of the individual resilient supports 82 could be replaced by a broad sheet of resilient material lying between the slats that are to be resiliently spaced from each other.

The longitudinal side supports 86 and longitudinal central support 88 also may be made of different materials to provide different levels of resilience, such as using rigid longitudinal side supports 86 and a resilient longitudinal central support 88 along the lateral central slat 74. Also, lateral central slats 80A, 80B need not all be made of the same material or constructed in the same way. Thus, FIG. 5, is further illustrative of the variety of design choices available within the present invention.

Figure 6:
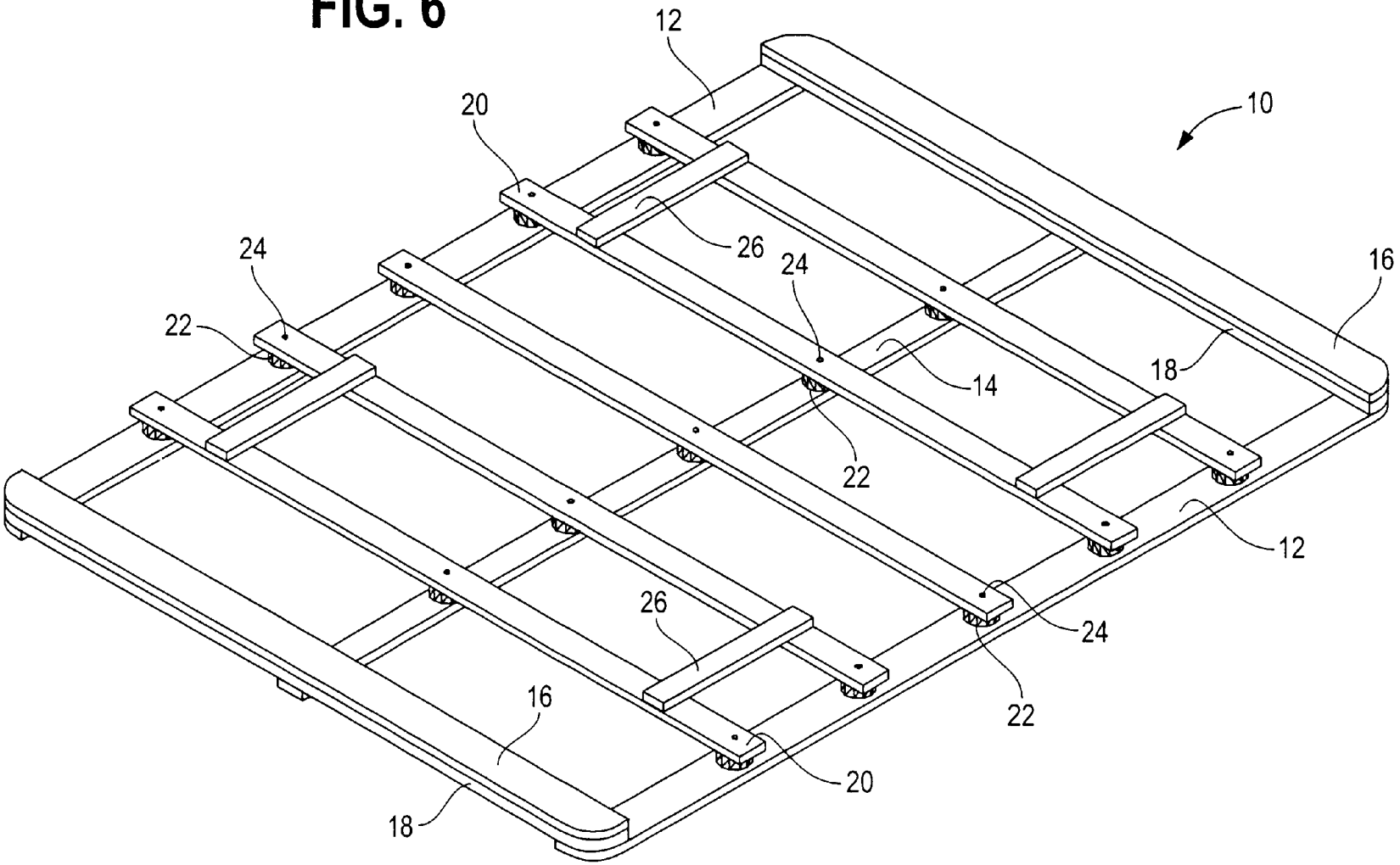
FIG. 6 is a perspective view of an alternative embodiment of a floating slat frame having relatively rigid ends and connectors between selected floating slats.

FIG. 6 presents an alternative embodiment that is very similar to the floating slat frame of FIG. 2, and therefore like parts have like reference numerals. However, the embodiment of FIG. 6 adds connectors 26 between selected lateral central slats 20, causing the movement of one of the connected lateral central slats 20 to influence the movement of another connected lateral central slat 20. Connectors 26 may be relatively rigid or flexible depending on the desired influence, and may be made of any of the above mentioned materials, as well as fabric, or the like. Also, connectors 26 may be attached to the respective lateral central slats 20, or to the lateral end slats 16 or 18, in any manner suitable for use with the materials employed, including for instance by mechanical fasteners, adhesives, or the like. Connectors 26 should be specifically located on the slats to avoid interfering with the attachment of a core assembly to the floating slat frame 10. Hence, connectors 26 should be positioned between attachment points for the core assembly, or alternatively may be attached to the underside of the lateral central slats 20. Thus, the embodiment of FIG. 6 offers still further ways in which the resilience of a mattress foundation may be tuned via the materials and construction of a floating slat frame for use therein.

Figure 7:
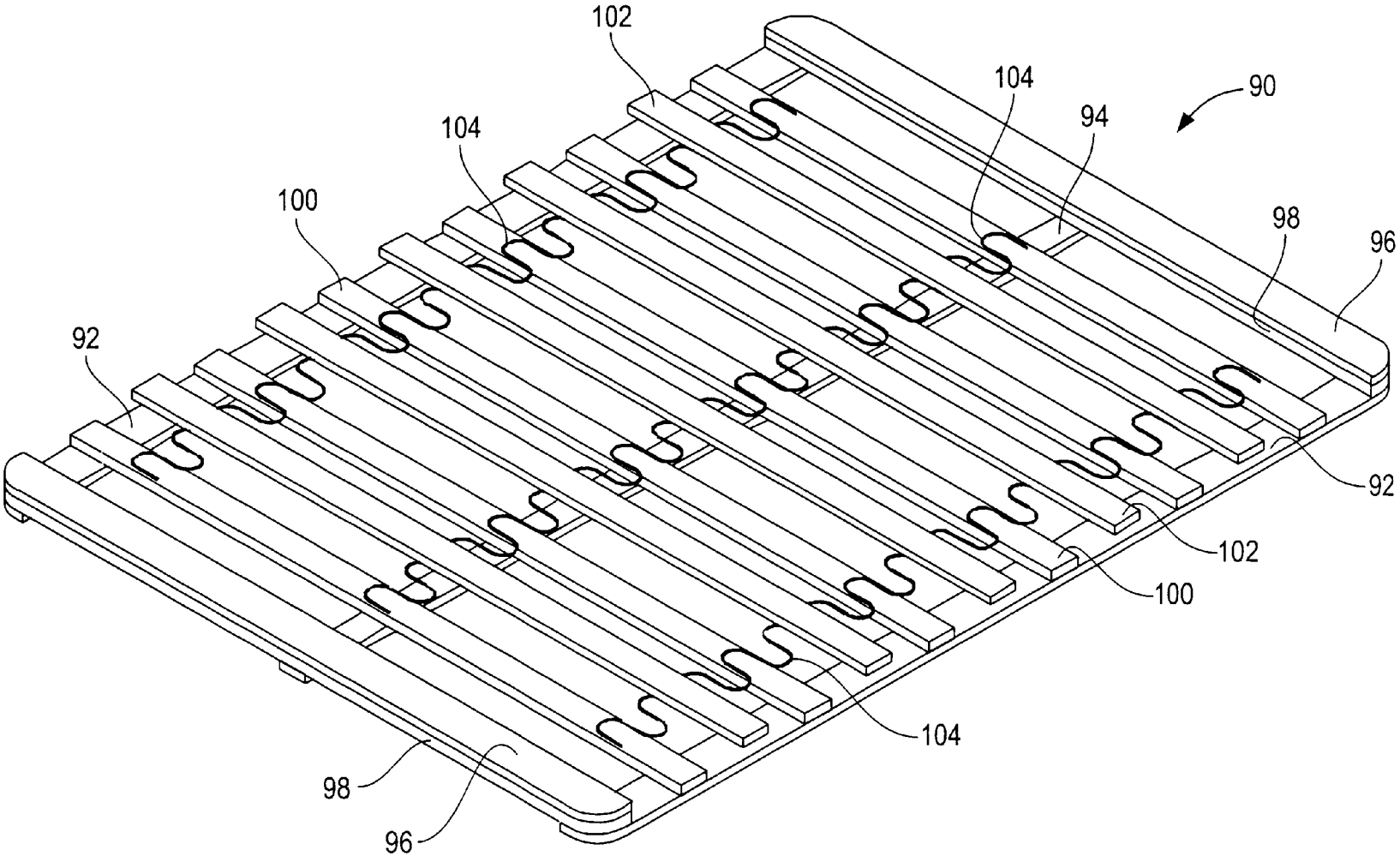
FIG. 7 is a perspective view of an alternative embodiment of a floating slat frame having relatively rigid ends and elongated resilient members.

Turning to FIG. 7, another alternative embodiment of a floating slat frame is provided. In this embodiment, floating slat frame 90 is constructed with longitudinal side slats 92 and longitudinal central slat 94. Frame 90 further includes lateral end slats 96, 98 and lateral central slats 100. In this construction, a first set of relatively rigid lateral end slats 96 overlap and are fixedly attached to a second set of relatively rigid lateral end slats 98. In turn, lateral end slats 98 overlap and are fixedly attached to the ends of longitudinal side slats 92 and longitudinal central slat 94. To complete the relatively rigid portion of the floating slat frame 90, lateral central slats 100 overlap and are fixedly attached at their ends to longitudinal side slats 92, while also overlapping and being fixedly attached to longitudinal central slat 94.

Resilience is provided in the embodiment of FIG. 7 by having additional lateral central slats 102 located in a plane resiliently spaced above the plane of slats 100 (when not subjected to a load). As shown, additional longitudinal supports 104 are strung between (floating) lateral central slats 102 and (fixed) lateral central slats 100. Supports 104 preferably are attached to the upperside of lateral central slats 100 and to the underside of lateral central slats 102, such as by mechanical fasteners. Supports 104 could be segmented, so as to be shorter in length and to provide some enhanced isolation of deflections along the length of the mattress foundation. Also, floating lateral central slats 102 and fixed lateral central slats 100 are longitudinally spaced from each other to permit some bending of supports 104.

Use of a sinusoidal spring wire for support 104 helps account for the deflection and varying elongation necessary in the support when the floating slat frame 90 is in under load in a mattress foundation. However, it will be appreciated that alternative shapes and materials, such as flat plastic or rubber banding, as well as alternative methods of attachment may be used for supports 104. Similarly, one skilled in the art will appreciate that depending on the shape and material of supports 104 used, the supports 104 also could run laterally, directly atop central slats 100, with floating slats 102 lying directly atop the supports. Accordingly, the embodiment of FIG. 7 further illustrates the flexibility in design available with the present invention.

Figure 8:
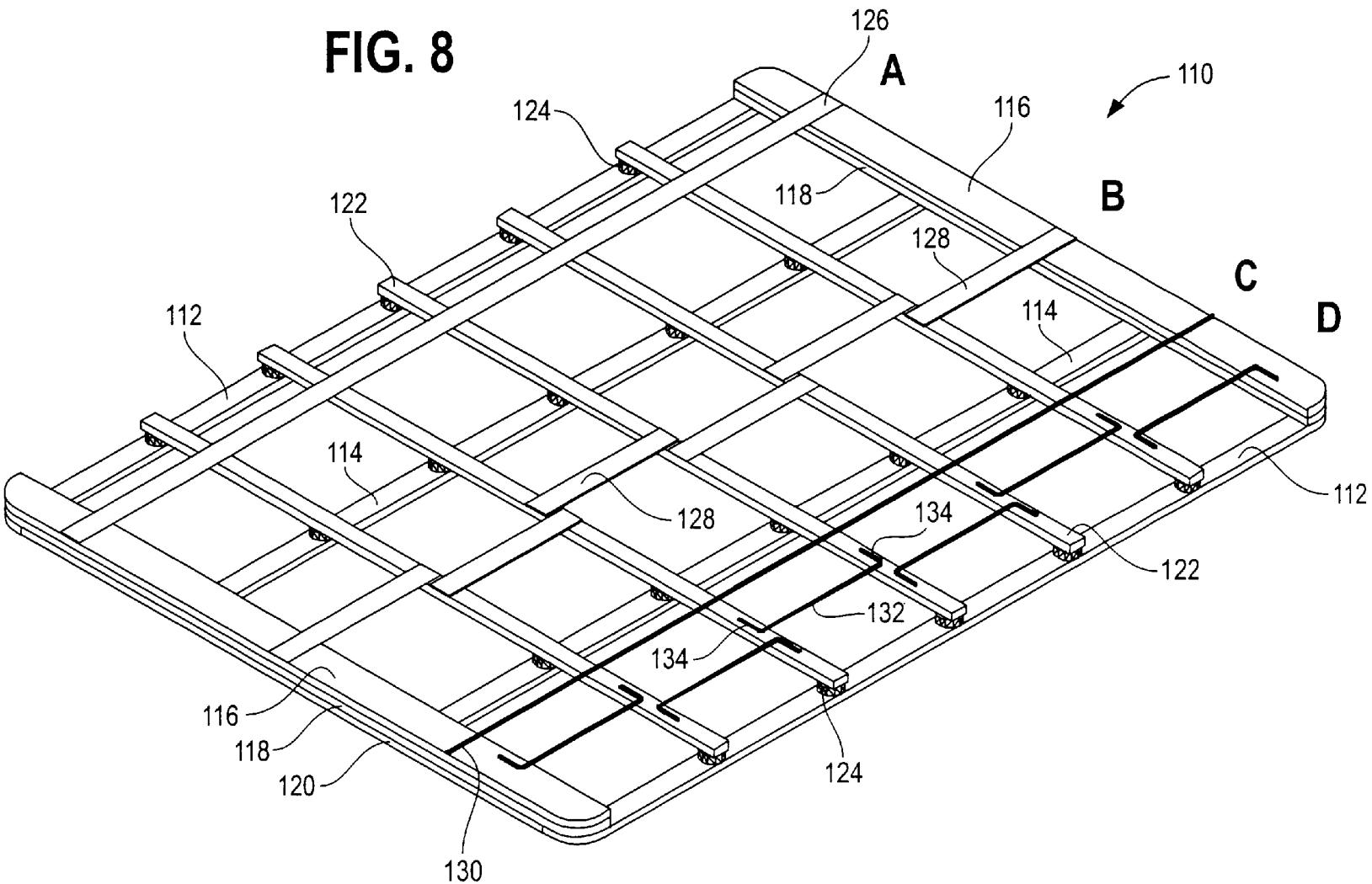
FIG. 8 is a perspective view of an alternative embodiment of a floating slat frame having relatively rigid ends and showing exemplary connector structures 8A–D.

FIG. 8 presents an alternative embodiment that is somewhat similar to the floating slat frame of FIG. 6, but includes two longitudinal central slats, lateral end filler slats, and offers several additional examples of connectors for use between slats. Hence, floating slat frame 110 of FIG. 8 includes longitudinal side slats 112 and longitudinal central slats 114, together with lateral end slats 116, 118, lateral end filler slats 120 and lateral central slats 122. It will be appreciated that lateral end filler slats 120 tend to be narrower than the remaining slats and are commonly used in base frames to provide additional support, to have the mattress foundation present to a bed frame a lower surface which is all in the same plane, and to assist in tailoring the upholstery.

Floating slat frame 110 may be constructed in a manner and of materials similar to those of the previously described embodiments. Thus, a first set of relatively rigid lateral end slats 116 overlap and are fixedly attached to a second set of relatively rigid lateral end slats 118, which overlap and are fixedly attached to the narrower lateral end filler slats 120. Lateral end slats 118 also overlap and are fixedly attached to the ends of longitudinal side slats 112 and longitudinal central slats 114. To provide resilience along the sides and in the central portion of floating slat frame 110, lateral central slats 122 are spaced apart from longitudinal side slats 112 and longitudinal central slats 114 by resilient supports 124.

While previously discussed fasteners could be used with this construction, FIG. 8 illustrates four examples (identified as A, B, C and D) of alternative connectors which may be used to help maintain the positions of the floating lateral central slats 122 relative to each other and to the remaining slats which are be fixedly connected to each other. For instance, the connector 126 of example A is connected to each of the floating lateral central slats 122 and the lateral end slats 116. Thus, connector 126 would tend to maintain the longitudinal spacing between floating lateral central slats 122 and lateral end slats 116, while also tending to maintain the lateral position of each of the floating lateral central slats 122. Accordingly, connectors 126 may alleviate the need for an individual fastener at the location of each resilient support 124. Connector 126, as depicted in example A, may be constructed of plastic, fabric, thin metal, or the like. Connector 126 also preferably has at least sufficient rigidity to inhibit the longitudinal and lateral displacement of the slats relative to each other. Any suitable method of attachment may be used to attach connector 126 to lateral end slats 116 and to lateral central slats 122, such as those discussed above with respect to previous embodiments.

Example B of FIG. 8 presents connectors 128 which are similar to connector 126, but segmented. This may permit use of shorter, more universal connectors. Also, depending on the selected material of connectors 128 and the method used to attach connectors 128 to lateral end slats 116 and lateral central slats 122, the segmented embodiment of example B may provide greater isolation of movement than in the full length connectors 126 of example A.

Example C of FIG. 8 presents connector 130 which is employed in the same manner as connector 126 of example A, but is of different construction. For instance, depending on the desired level of rigidity and influence of movement from one lateral central slat 122 to another, connector 130 may be made of wire, plastic, rope, or the like. Various methods of attachment of connector 130 may be used, such as the common practice of stapling, or the like. Also, connector 130 need not simply be linear, as alternative shapes, such as the sinusoidal wire 104 in FIG. 7 may be used.

Example D of FIG. 8 presents connectors 132 which are similar to connector 130, but segmented in a manner much like connectors 128 of example B. Connectors 132 provide similar benefits to those mentioned above with respect to connectors 128. However, connectors 132 also have a perpendicular portion 134 at each end which may facilitate easier or more secure attachment to lateral end slats 116 and lateral central slats 122. Also, if connectors 132 are made of bent wire, and if the perpendicular portions 134 of successive connectors are aligned and the connectors are attached to the lateral end slats 116 and lateral central slats 122 only along the perpendicular portions 134, then the connections will have a hinge affect that promotes isolation among the lateral central slats 122.

Figure 9:
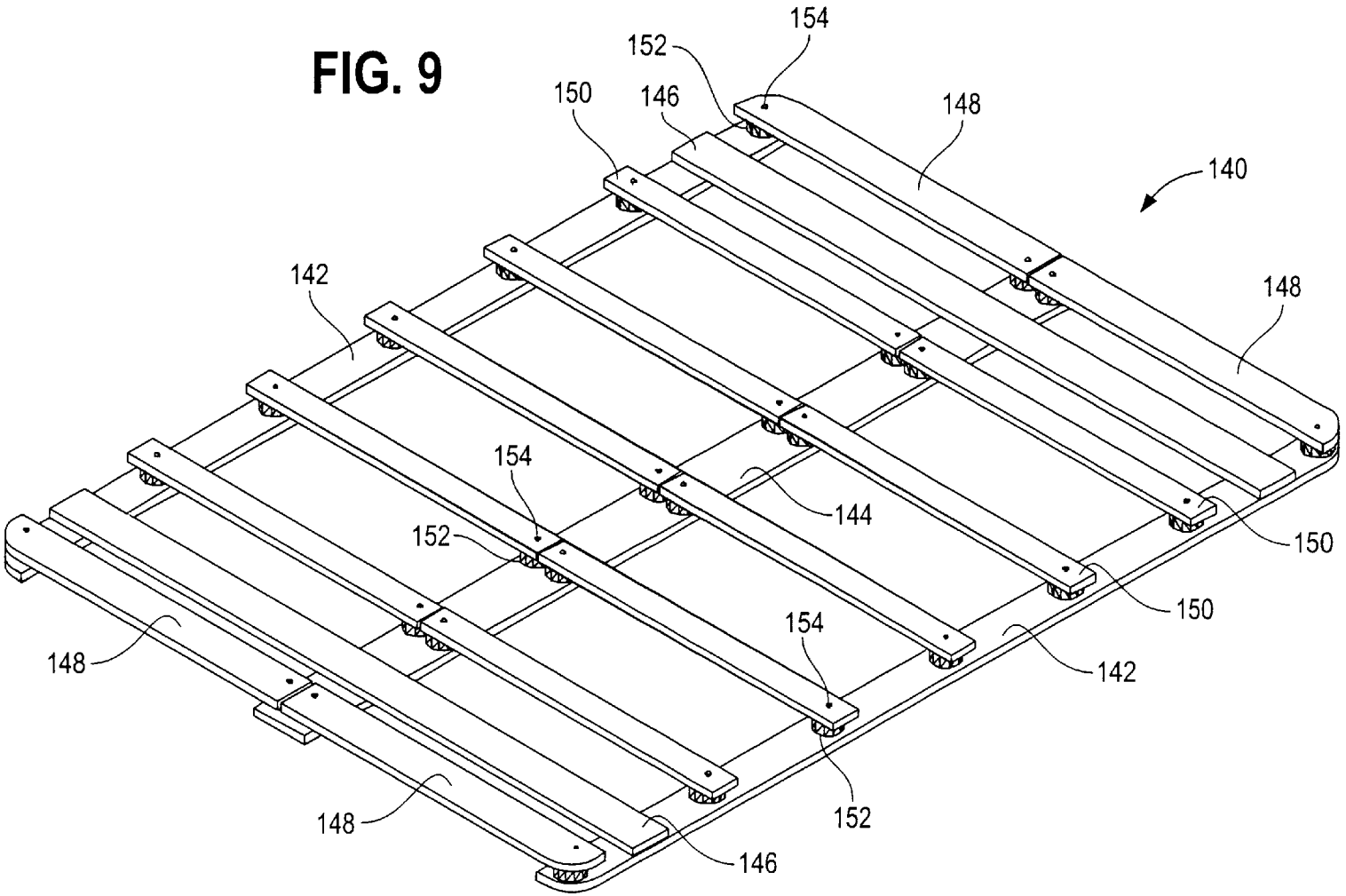
FIG. 9 is a perspective view of a floating slat frame having segmented floating slats for improved side-to-side isolation.

Turning to FIG. 9, a further alternative embodiment of a floating slat frame is shown. Floating slat frame 140 is designed to provide resilience throughout the floating slat frame 140, and to more aggressively address the side-to-side isolation of mattress foundation deflection for mattresses made to accommodate two or more people. Accordingly, floating slat frame 140 includes longitudinal side slats 142 and longitudinal central slat 144, together with lateral slats 146, lateral end slats 148 and lateral central slats 150. One skilled in the art will appreciate that the ends of lateral slats 146 overlap and are fixedly attached to longitudinal side slats 142, while lateral slats 146 also overlap and are fixedly attached to longitudinal central slat 144. This basic structure provides rigidity for floating slat frame 140 to engage a bed frame.

The embodiment of FIG. 9 features the use of lateral central slats 146 and pairs of lateral end slats 148 and to run the width of floating slat frame 140. Use of lateral slats 146 inboard of the lateral end slats 148 of the frame 140 permits the outward ends of lateral end slats 148 and lateral central slats 150 to be spaced from longitudinal side slats 142 by use of resilient supports 152 and fasteners 154. Similarly, inward ends of lateral end slats 148 and lateral central slats 150 are spaced from longitudinal central slat 144 by use of resilient supports 152 and fasteners 154. This segmented construction provides further isolation of movement across the width of a mattress foundation, and may incorporate a variety of resilient supports to achieve different resilience for left and right hand positions within the same mattress foundation. Hence, consistent with the above discussion of previous embodiments, FIG. 9 provides a further example embodiment illustrating the many options available to a bedding designer in the selection of materials and construction to manufacture a floating slat frame of the present invention.

Referring now generally to FIGS. 10–15, it will be appreciated that a floating slat frame of the present invention may be used in combination with various relatively rigid or resilient core assemblies to provide the inner structure for a mattress foundation.

Figure 10:
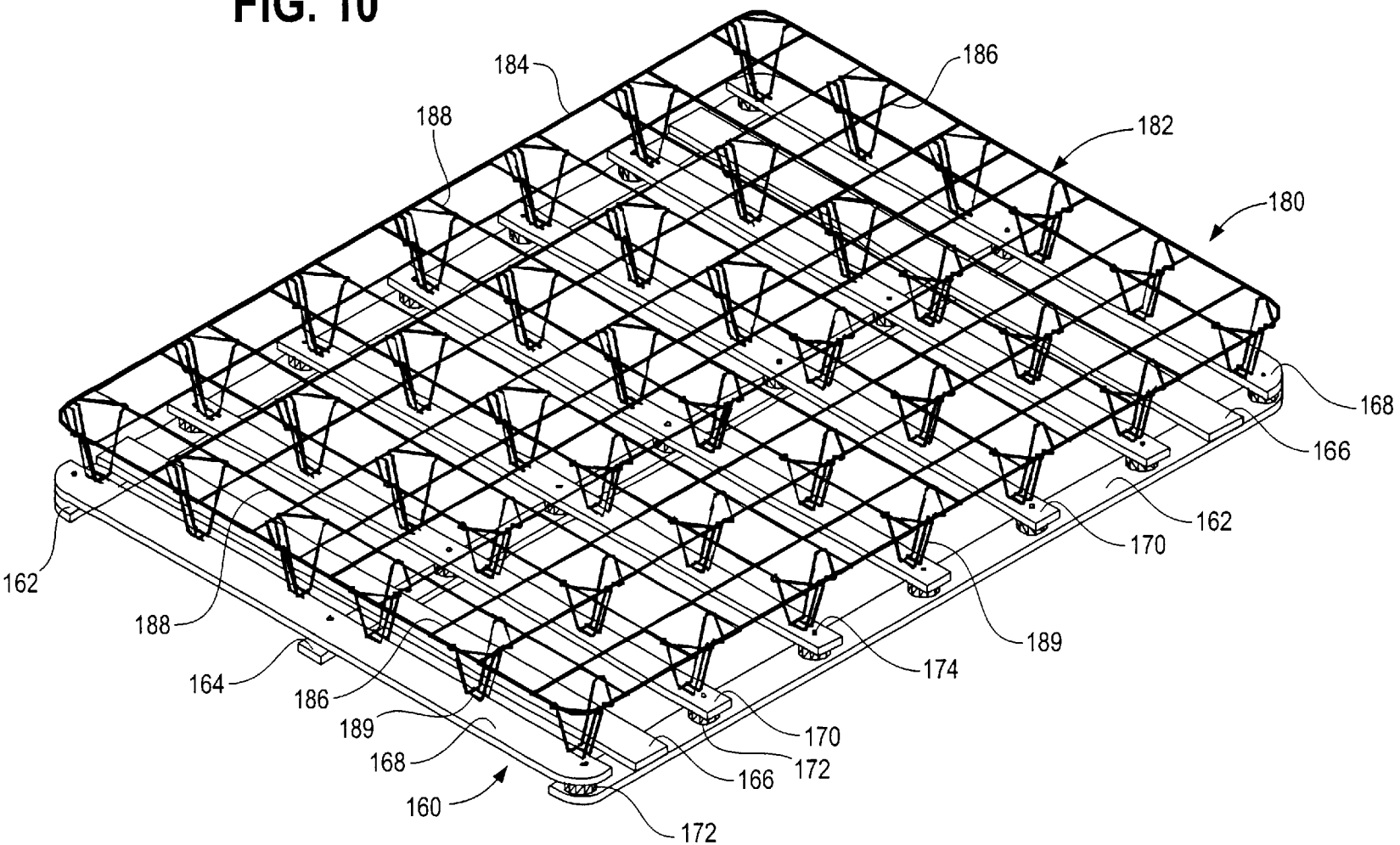
FIG. 10 is a perspective view of a floating slat frame in combination with a relatively rigid core assembly.

In particular, FIG. 10 shows a floating slat frame 160, similar to that of FIG. 9 but without segmented lateral slats, in combination with a relatively rigid core assembly 180. Floating slat frame 160 includes longitudinal side slats 162 and longitudinal central slat 164, together with lateral slats 166, lateral end slats 168 and lateral central slats 170. The ends of lateral slats 166 overlap and are fixedly attached to longitudinal side slats 162, while lateral slats 166 also overlap and are fixedly attached to longitudinal central slat 164. This provides a relatively rigid bottom for floating slat frame 160 to engage a bed frame.

Having lateral slats 166 inboard of the lateral end slats 168 of the frame 160 permits the ends of lateral end slats 168 and lateral central slats 170 to be spaced from longitudinal side slats 162 by use of resilient supports 172 and fasteners 174. Similarly, lateral end slats 168 and lateral central slats 170 are spaced from longitudinal central slat 164 by use of resilient supports 172 and fasteners 174. Hence, the various slats of floating slat frame 160 are connected in a manner similar to that of FIG. 9, but the lateral end slats 168 and lateral central slats 170 are not segmented.

Relatively rigid core assembly 180 is described and claimed in U.S. Pat. No. 5,967,499 and is manufactured and sold by Hickory Springs Manufacturing Company, under the trademark PowerStack. Core assembly 180 generally includes an upper grid assembly 182 preferably made of bent and straight pieces of wire. Upper grid assembly 182 further includes a rectangular border wire 184, longitudinal straight wires 186 and lateral straight wires 188. Border wire 184, longitudinal straight wires 186 and lateral straight wires 188 may be connected in a suitable manner, such as by welding, clips, wrapping, or the like, where they cross each other respectively. A series of load transmitting and spacing modules 189 is connected to the grid assembly 182 in a suitable manner, such as by welding, clips, or the like. Also, core assembly 180 is preferably connected to lateral end slats 168 and lateral central slats 170 at the base of modules 189 by mechanical fasteners, such as staples, nails, or the like.

The construction of core assembly 180 is particularly advantageous for its longitudinal and lateral stability, and because it may be conveniently stacked with like core assemblies for compact storage or shipment. However, if core assembly 180 is combined with a standard base frame, such as shown in FIG. 1, the resulting mattress foundation will be rigid and susceptible to promoting a bottoming feeling in an overlying mattress placed under load. With a core assembly 180 constructed of wire, the resilience of floating slat frame 160 will enable the core assembly 180 to deflect under load. Thus, floating slat frame 160 may be used to introduce resilience in mattress foundations using relatively rigid core assemblies.

Figure 11:
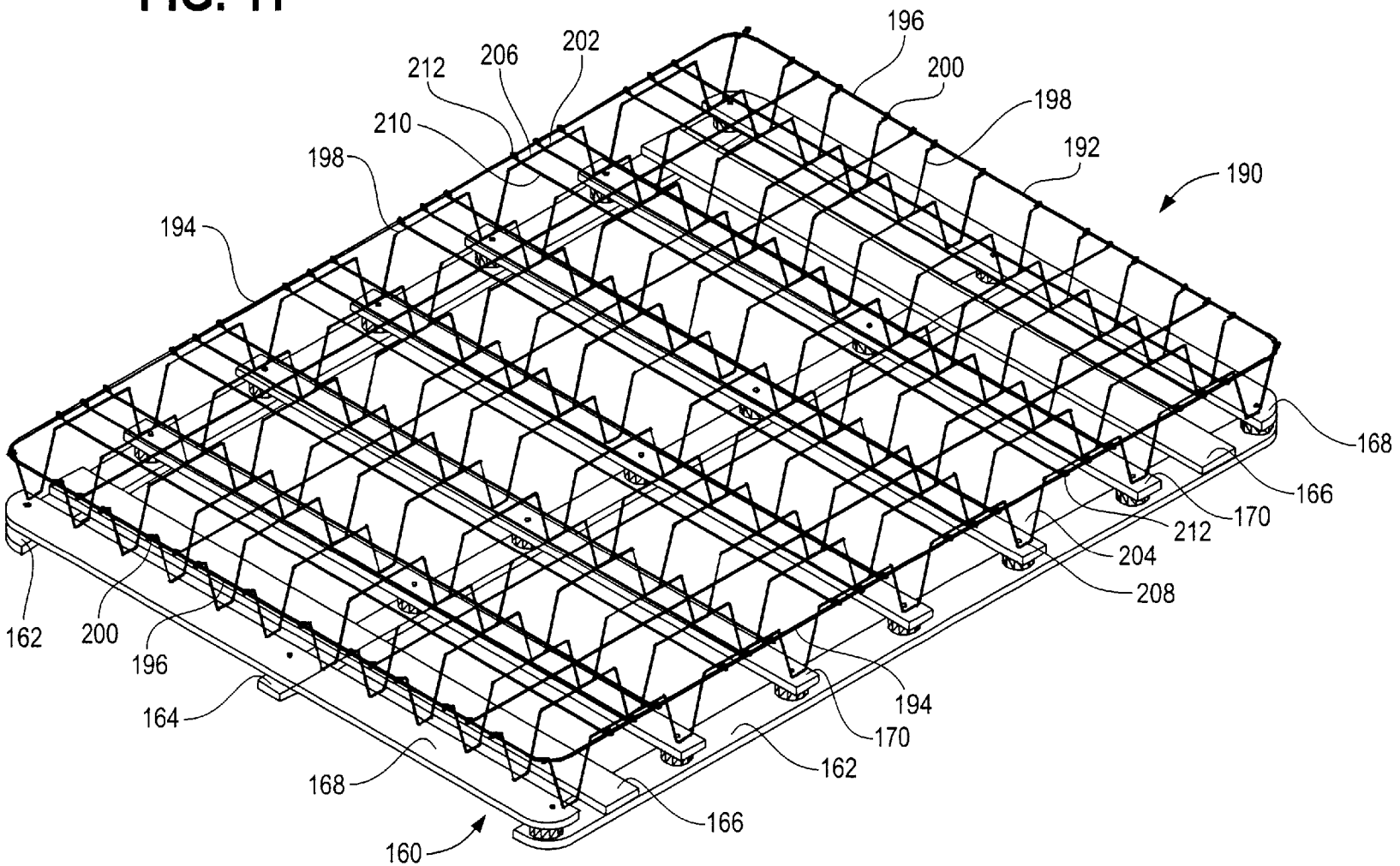
FIG. 11 is a perspective view of the floating slat frame of FIG. 10 in combination with an alternative embodiment of a relatively rigid core assembly.

FIG. 11 shows the floating slat frame 160 of FIG. 10 in combination with a relatively rigid core assembly 190. The description of floating slat frame 160 is provided above with respect to FIG. 10, and will not be repeated here. The core assembly 190 is described and claimed in U.S. Pat. No. 5,052,064 and is manufactured and sold by Leggett & Platt, Incorporated, under the name Semi-Flex®. Core assembly 190 also is conveniently stackable for compact storage or shipment and would benefit (similarly to the relatively rigid core assembly 180 of FIG. 10) from being mounted on a floating slat frame, as opposed to the relatively rigid base frame depicted in U.S. Pat. No. 5,052,064 or the standard base frame shown in FIG. 1.

Core assembly 190 includes a rectangular border wire 192 having two parallel sides 194 and 101 two parallel ends 196. The core assembly 190 further includes transversely-space, parallel, and longitudinally-extending support wires 198 parallel to the sides 194 of border wire 192 and having ends 200 connected to the border wire ends 196. Support wires 198 are generally corrugated along their lengths and have peaks 202 and valleys 204, with the peaks 202 being flattened at their tops 206 and being generally coplanar with a plane defined by the border wire 192. The valleys 204 of the support wires 198 are flattened at their extrememost locations 208, and are vertically displaced beneath and intermediate of the flattened peaks 202. Core assembly 190 further includes longitudinally-spaced, parallel, and transversely-extending upper connector wires 210 parallel to the border wire ends 196 and having ends 212 connected to the border wire sides 194. The upper connector wires 210 are connected intermediate of their ends 212 along their lengths to the flattened 20 peaks 202 of support wires 198.

Consistent with the discussion of the above alternative embodiments and the disclosure of U.S. Pat. No. 5,052,064, core assembly 190 is preferably made of individual straight and bent pieces of wire, which may be connected in any suitable manner, such as by welding, crimping, or the like. Also, core assembly 190 is preferably fixedly connected to lateral end slats 168 and lateral central slats 170 of floating slat frame 160 at the flattened valleys 208 of support wires 198 by mechanical fasteners, such as staples, nails, or the like.

Figure 12:
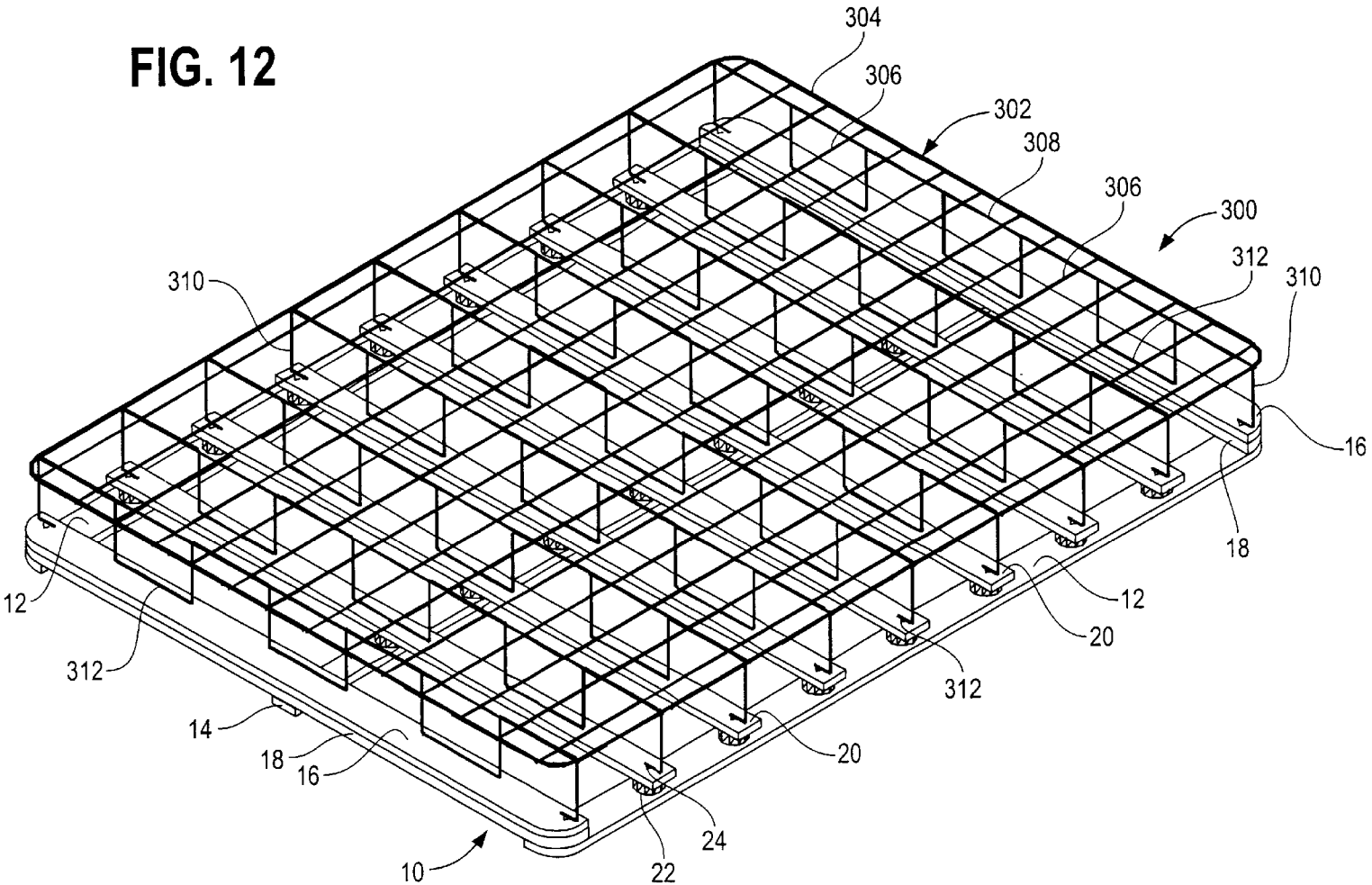
FIG. 12 is a perspective view of an alternative embodiment of a floating slat frame having relatively rigid ends in combination with an alternative embodiment of a relatively rigid core assembly.

Turning now to FIG. 12, the floating slat frame 10 of FIG. 2 is shown in combination with a relatively rigid core assembly 300. The description of floating slat frame 10 is provided above with respect to FIG. 2, and will not be repeated here. Core assembly 300 is a simplified illustration of the collapsible core assembly described and claimed in U.S. Pat. No. 4,377,279. Core assembly 300 may be conveniently collapsed on top of frame 10 for relatively compact storage or shipment of completed frame and core assembly units. Given the relative rigidity of core assembly 300, it would benefit (similarly to the relatively rigid core assembly 180 of FIG. 10) from being mounted on floating slat frame, as opposed to the relatively rigid base frame depicted in U.S. Pat. No. 4,377,279 or the standard base frame shown in FIG. 1.

As with several of the above alternative embodiments and the disclosure of U.S. Pat. No. 4,377,279, core assembly 300 is preferably made of individual straight and bent pieces of wire. Core assembly 300 includes a grid wire top bearing structure 302 having a rectangular border wire 304, longitudinal straight wires 306 and lateral straight wires 308. Border wire 304, longitudinal straight wires 306 and lateral straight wires 308 may be connected in any suitable manner, such as by welding, crimping, or the like, where they cross each other respectively. Lateral straight wires 308 are further hingedly connected to parallel rows of longitudinally-spaced, laterally-extending support members 310, such as by clips. Also, support members 310 are further hingedly connected at their extreme most lower locations 312 to lateral end slats 16 and lateral central slats 20 of floating slat frame 10, by mechanical fasteners, such as staples, nails, or the like.

Figure 13:
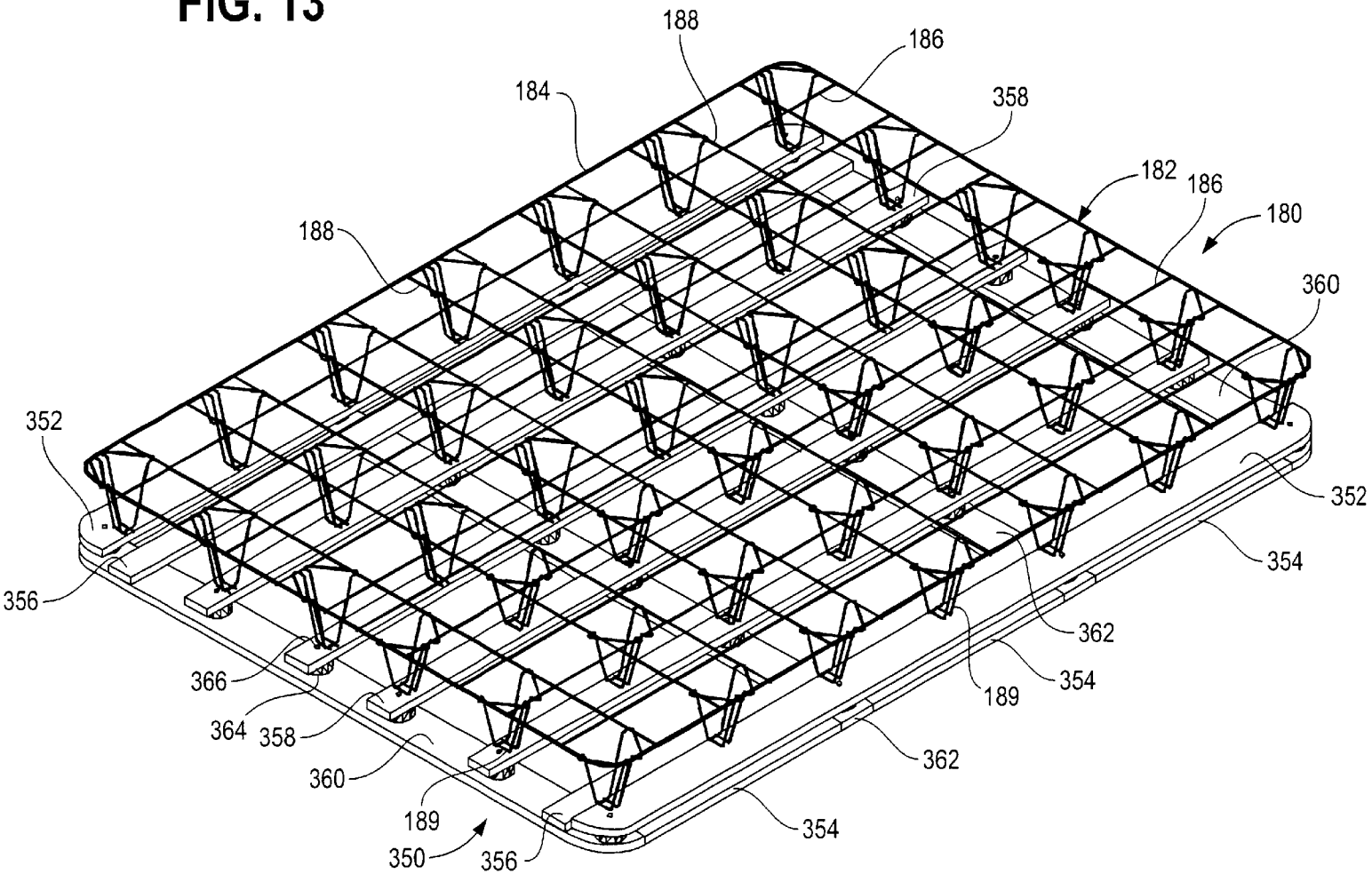
FIG. 13 is a perspective view of an alternative embodiment of a floating slat frame having a longitudinal orientation of the floating slats in combination with the relatively rigid core assembly of FIG. 10 for improved side-to-side isolation.

FIG. 13 presents an alternative embodiment of a floating slat frame 350 in combination with the relatively rigid core assembly 180 of FIG. 10. Floating slat frame 350 offers the alternative of having longitudinal floating slats for improved side-to-side isolation of movement. In particular, frame 350 includes longitudinal side slats 352, longitudinal filler slats 354, fixed longitudinal central slats 356 and floating longitudinal central slats 358, together with lateral end slats 360 and lateral central slats 362. The ends of longitudinal slats 356 overlap and are fixedly attached to lateral end slats 360, while longitudinal slats 356 also overlap and are fixedly attached to lateral central slats 362, by any of the above discussed suitable attachment methods. In contrast, the ends of longitudinal side slats 352 and longitudinal central slats 358 are held in a floating spaced relationship relative to lateral end slats 360 by resilient supports 364 and fasteners 366, in a similar manner to the previously discussed alternative embodiments. Similarly, longitudinal side slats 352 and longitudinal central slats 358 are preferably resiliently spaced from lateral central slats 362 by resilient supports 364 and fasteners 366.

Relatively rigid core assembly 180 is described above in reference to FIG. 10. However, with the change in orientation of the floating slats in floating slat frame 350 of FIG. 13, core assembly 180 is attached to longitudinal side slats 352 and longitudinal central slats 358 at the bottom of modules 189, preferably by mechanical fasteners, such as staples, nails, or the like. The use of floating longitudinal side slats 352 and longitudinal central slats 358 should reduce the transmission of deflection across the width of the mattress foundation.

Figure 14:
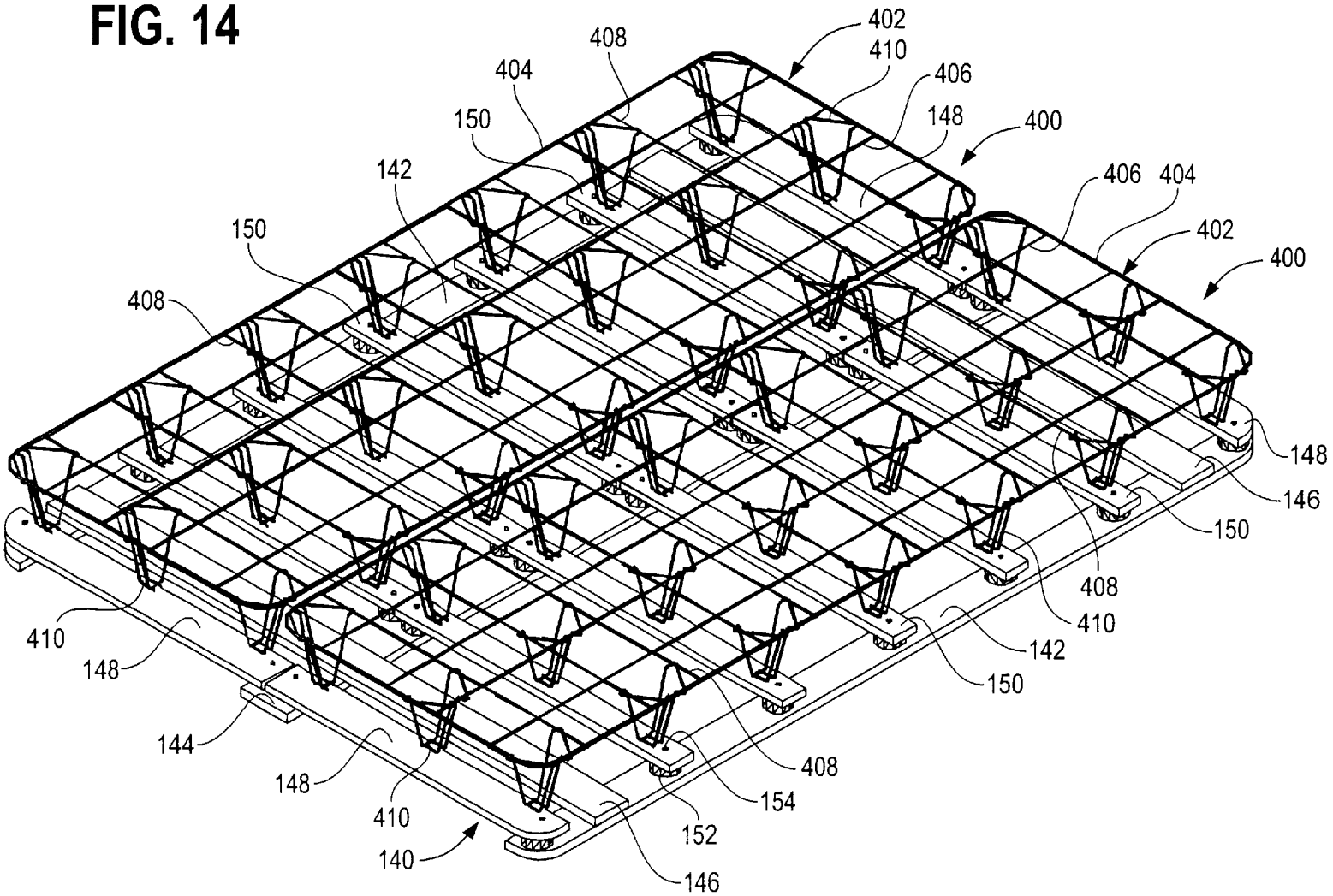
FIG. 14 is a perspective view of the floating slat frame of FIG. 9 having segmented floating slats in combination with a plurality of relatively rigid core assemblies for further improved side-to-side isolation.

The alternative embodiment of FIG. 14 includes the floating slat frame 140 of FIG. 9 in combination with a pair of relatively rigid core assemblies of similar construction to core assembly 180 of FIG. 10. The description of floating slat frame 140 is provided above with respect to FIG. 9, and will not be repeated here. This embodiment goes to greater lengths to isolate deflection across the width of a mattress foundation by using segmented floating lateral end slats 148 and segmented floating lateral central slats 150 in combination with a pair of entirely separate, longitudinally extending core assemblies 400.

Each core assembly 400 generally includes an upper grid assembly 402 preferably made of bent and straight pieces of wire. Upper grid assembly 402 further includes a rectangular border wire 404, longitudinal straight wires 406 and lateral straight wires 408. Border wire 404, longitudinal straight wires 406 and lateral straight wires 408 may be connected in a suitable manner, such as by welding, crimping, or the like, where they cross each other respectively. Bent wire modules 410 are connected to the grid assembly 402 in a suitable manner, such as by welding, clips or the like. Also, each core assembly 400 is preferably connected to lateral end slats 148 and lateral central slats 150 at the base of the modules 410 by mechanical fasteners, such as staples, nails, or the like.

Figure 15:
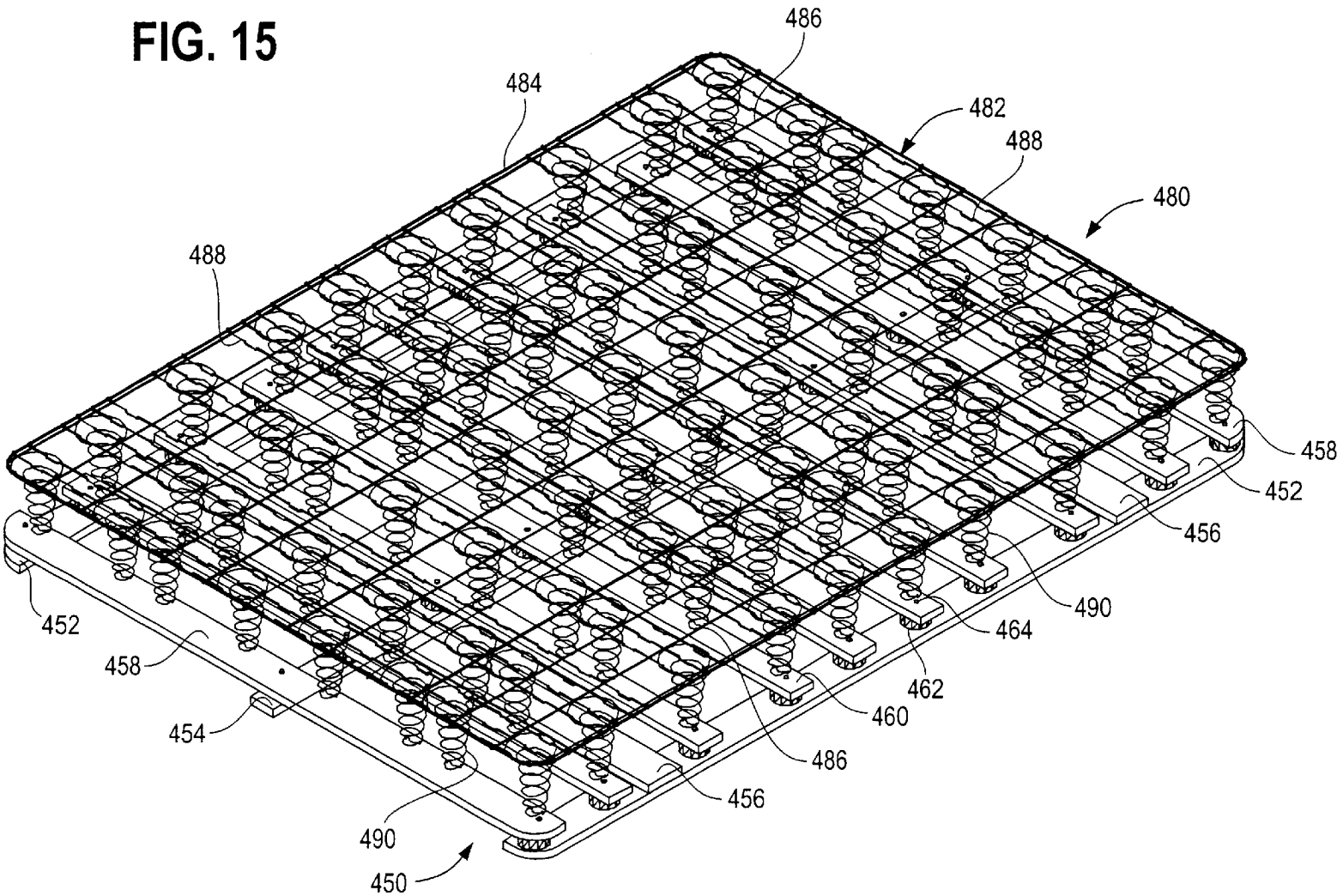
FIG. 15 is a perspective view of an alternative floating slat frame in combination with a resilient core assembly.

The use of segmented floating lateral end slats 148 and segmented lateral central slats 150 and, in essence, a split queen version of a relatively rigid core assembly, yielding two narrower core assemblies 400, basically disconnects the right side of the mattress foundation from the left side with respect to deflections, other than through a load which is simultaneously applied to both sides or through the padding and covering (not shown) used in a finished product. The possibility of separate resilience tuning for left and right hand positions within the mattress foundation, as discussed above in relation to floating slat frame 140 of FIG. 9, would be further enhanced by the use of separate core assemblies 400. Moreover, two core assemblies having different relative rigidities could be used in place of like core assemblies 400, to further differentiate between the resilience of the left and right hand portions of a mattress foundation. Turning now to FIG. 15, a floating slat frame 450 is shown in combination with a resilient core assembly 480. Frame 450 is very similar to floating slat frame 160 of FIG. 10, but incorporates additional lateral slats to provide more mounting points for the core assembly 480, and has fixed lateral slats mounted slightly closer toward the center of the floating slat frame 450. In particular, floating slat frame 450 includes longitudinal side slats 452 and longitudinal central slat 454, together with lateral slats 456, lateral end slats 458 and lateral central slats 460. The ends of lateral end slats 458 and lateral central slats 460 are spaced from respective longitudinal side slats 452 and central slat 454 by resilient supports 462 and fasteners 464. Similarly, lateral end slats 458 and lateral central slats 460 are spaced from respective longitudinal central slat 454 using similar resilient supports 462 and fasteners 464. Consistent with the embodiments discussed above, use of fixed lateral slats 456 inboard of the lateral end slats 458 permits the lateral end slats 458 as well as the lateral central slats 460 to be resiliently spaced from longitudinal side slats 452 and longitudinal central slat 454. Also consistent with the above discussed alternative embodiments, various ways of attaching the slats may be used, and the slats and resilient supports 462 may be made of any suitable materials to achieve the desired design.

The resilient core assembly 480 of FIG. 15 is described and claimed in U.S. Pat. No. 5,184,802 and is manufactured and sold by Hickory Springs Manufacturing Company, under the trademark PowerBase. Resilient core assembly 480 has an upper grid assembly 482. Any one of many grid assembly configurations may be suitable for use in a resilient core assembly, but here grid assembly 482 includes a rectangular border wire 484, straight longitudinal wires 486, and lateral wires 488. In this particular exemplary embodiment, lateral wires 488 further include pocketed bends to assist in locating and mounting resilient modules 490 to the grid assembly 482. Resilient modules 490 are shown as coil springs, however, it will be appreciated that many different resilient members, including for instance bent wire spring modules, may be used to resiliently space grid assembly 482 from floating slat frame 450. In turn, the lower end of resilient modules 490 are connected to lateral end slats 458 and lateral central slats 460 of floating slat frame 450.

This additional source of resilience contributed by floating slat frame 450 adds a further dimension to the bedding designer's ability to tune the performance of the mattress foundation. Indeed, it permits at least a two stage design, and allows manufacturers to use the same core assembly atop different base frames to achieve a variety of end products having different performance characteristics. In addition, a standard base frame, such as shown in FIG. 1, typically has slats within two planes. However, manufacturers are introducing thicker mattress foundations as a premium product. Hence, a further added benefit of the floating slat frame of the present invention is that it will add thickness to the mattress foundation, without having to construct a taller core assembly.

Turning now to FIGS. 16–21, a variety of resilient supports are shown for use in floating slat frames. The exemplary resilient supports have been grouped, in large part by their construction of acceptable materials for manufacture. It is important to note that these alternative supports may be used in any combination with each other, and include a variety of different ways of achieving attachment to slats.

Figure 16:
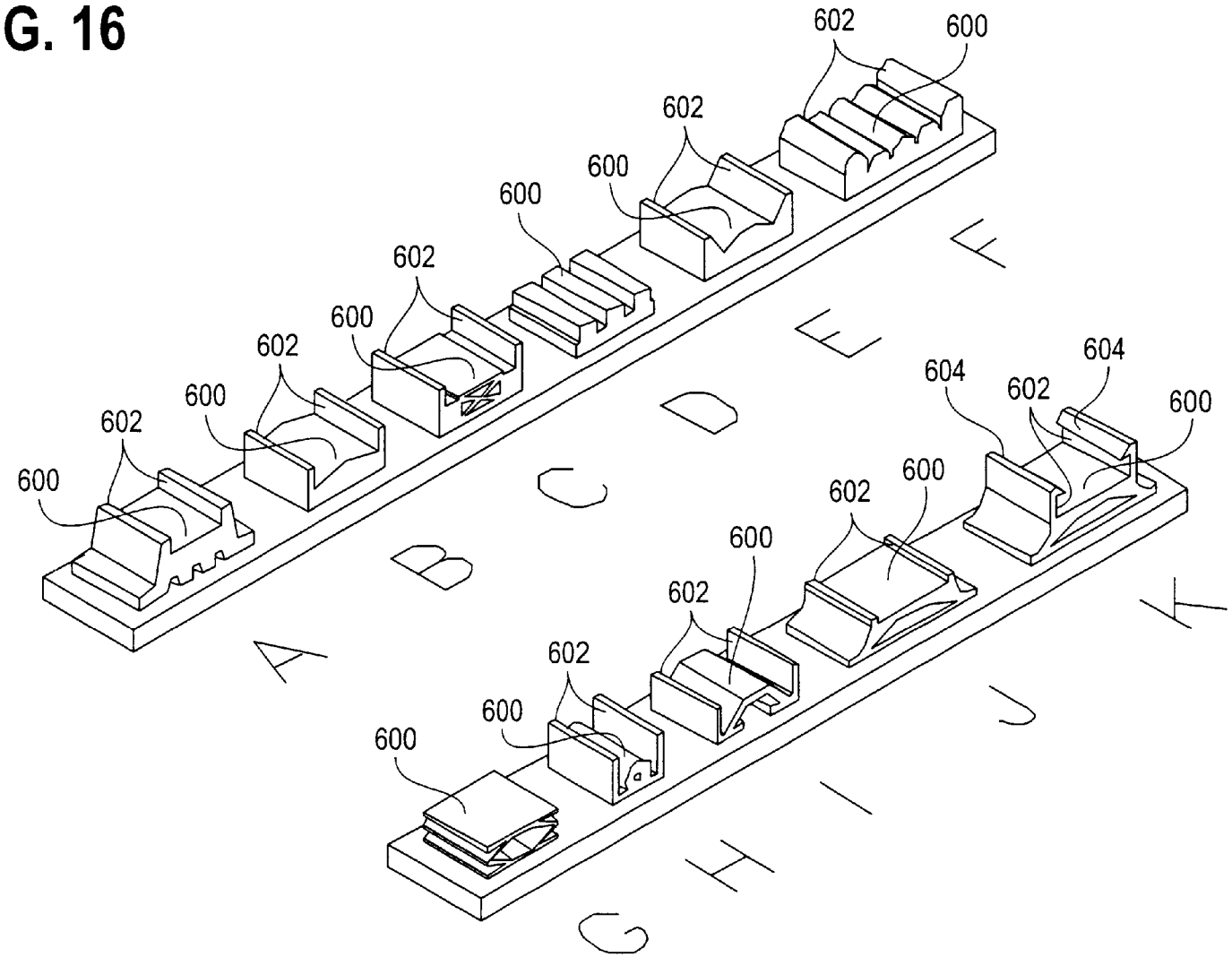
FIG. 16 is a perspective view of exemplary floating slat supports 16A–K.

FIG. 16 presents examples A–K of resilient supports that may be made of plastic materials, such as polyethylene, polypropylene, polyester, polyurethane, or the like, or rubber materials, such as neoprene, latex, foam rubber, or the like, and preferably are formed by extrusion or molding. Of the examples A–K, each of them presents an upward facing contact surface 600 to engage the underside of an overlying slat and a profile which includes some void relative to receiving a load from the underside of an overlying slat, so as to provide for temporary crushing of the support under load. Also, each of the examples A–K may be independently attached to underlying and overlying slats via mechanical fasteners, such as staples, nails, or the like, or via adhesives. Alternatively, mechanical fasteners that simultaneously engage the underlying and overlying slats as well as the support, such as fasteners 24 described in reference to FIG. 2, may be used with any of the examples A–K.

Examples A–C, E–F and H–K of FIG. 16 also incorporate upstanding projections 602 to assist in locating an overlying slat relative to a support, and to permit convenient attachment of a support to a slat by use of different fasteners. For instance, if using a support having upstanding projections 602, one may use less sophisticated fasteners to attach supports to slats, such as by stapling through the projections 602 and into the sides of an overlying slat. Further, example K also incorporates locking projections 604 to provide a snap fit for an overlying slat. It will be appreciated that some support constructions may be less desirable for particular uses, such as attempting to use with an end slat a resilient support of examples A, F or J–K which have a large base that extends perpendicularly to the slat. Such use could cause the support to protrude outward from the end of the mattress foundation. In such an instance, a support having a more compact structure that is intended to be located entirely between the underlying and overlying slats may be more suitable.

Figure 17:
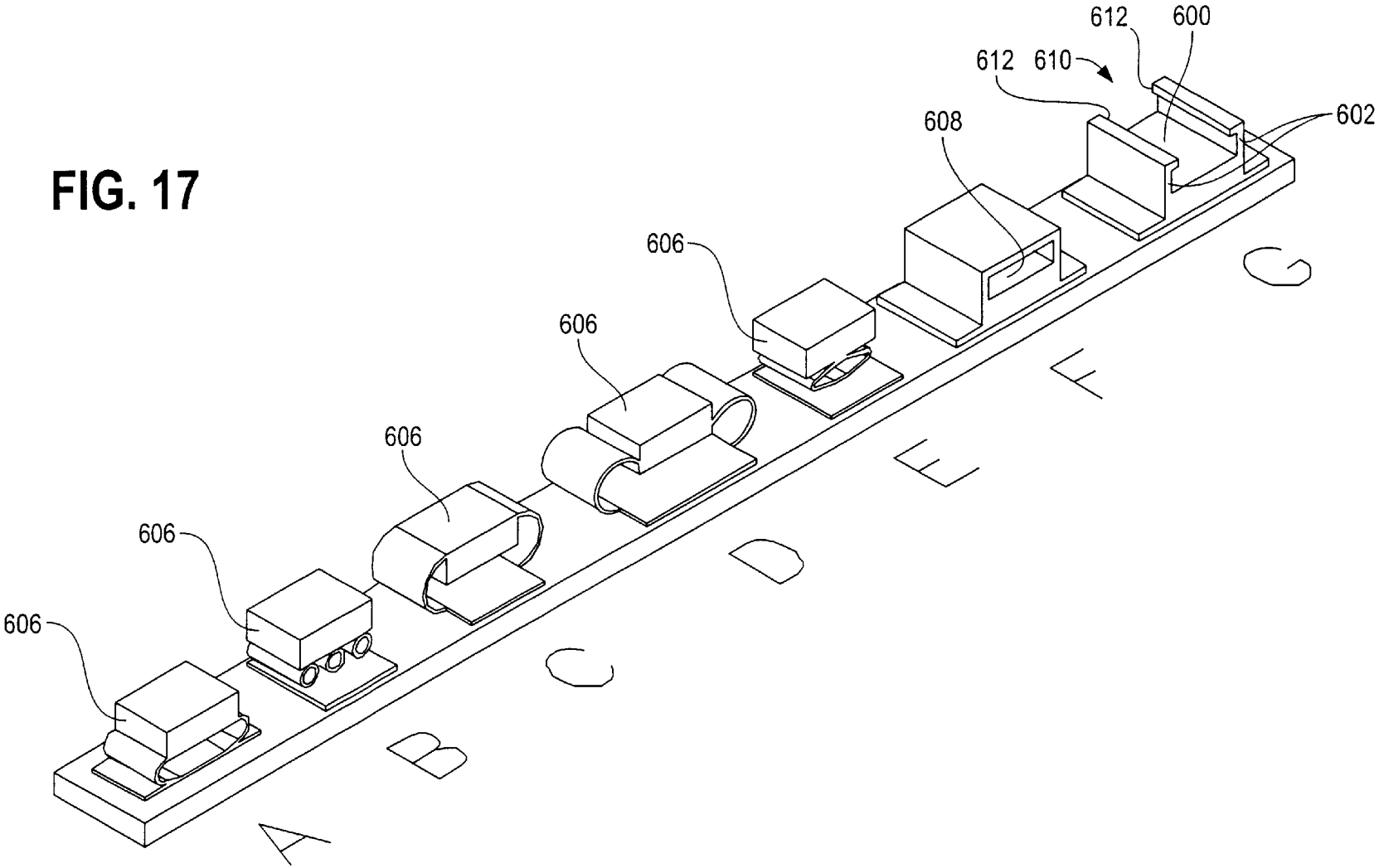
FIG. 17 is a perspective view of alternative exemplary floating slat supports 17A–G.

FIG. 17 provides examples A–G which also may be made of plastic materials such as discussed in reference to FIG. 16. However, examples A–G of FIG. 17 tend to use reduced wall thicknesses, and to encapsulate the end of a slat, such as in slat receiving compartments 606 of examples A–E (shown from the closed rear side), or to more completely surround the end of a slat, such as in passage 608 of example F, or to capture the slat in a slot 610 formed by an upward facing contact surface 600 and upstanding projections 602 with inward facing extensions 612 as in example G. These constructions would permit an alternative method of attachment to the ends of slats by slightly undersizing the respective engaging compartment, passage or slot to achieve an interference fit with the end of an inserted slat. Moreover, if one of the encapsulating supports is used at each end of a given floating slat, even without an interference fit, the slat will be trapped between the respective supports at its ends. This eliminates the need to use fasteners to attach the supports to the floating slat. Also, examples A–G tend to be less suitable for use with the type of fasteners which simultaneously engage the underlying and overlying slats and the resilient support, such as discussed in relation to FIG. 2. Instead, examples A–G are better suited for use with fasteners or adhesives that provide for independent attachment of the support to the underlying and overlying slats.

Figure 18:
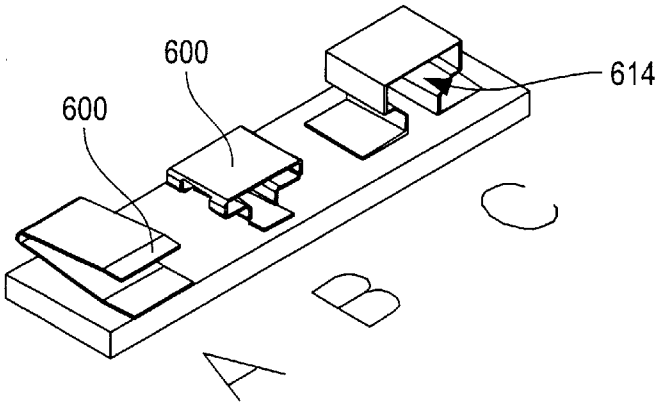
FIG. 18 is a perspective view of alternative exemplary floating slat supports 18A–C.

Examples A–C of FIG. 18 are alternative resilient supports that may be made of plastic materials discussed above, thin metal, or the like, and preferably are formed by extrusion or conventional metal forming techniques. Examples A and B have an upward facing contact surface to engage the underside of an overlying slat. Example C presents a partial passage 614 to receive the end of a slat. As with the examples A–G of FIG. 17, the alternative supports of examples A–C of FIG. 18 tend to be less suitable for use with fasteners which simultaneously engage the underlying and overlying slats and the resilient support, and are better suited for independent attachment to the underlying and overlying slats by mechanical fasteners, adhesives, or the like. They also present a more compact structure, which makes them more suitable with floating lateral end slats, such as in FIGS. 3, 9–11 and 14–15, or floating longitudinal side slats, such as in FIG. 13.

Figure 19:
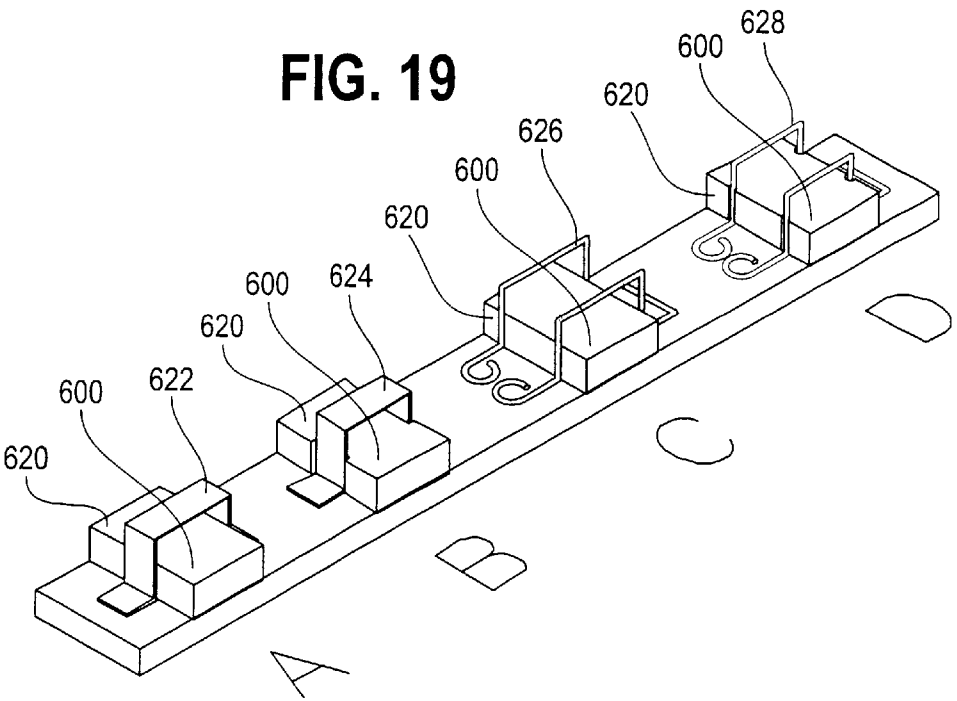
FIG. 19 is a perspective view of alternative exemplary floating slat supports 19A–D.

FIG. 19 presents examples A–D that utilize a combination of a resilient pad 620 and an overlying strap. The pads have an upward facing surface 600 to engage the underside of an overlying slat. In examples A–B, the straps 622, 624 are shaped like a band and may be made of plastic materials as discussed above, thin metal, fabric, rubber materials, or the like, and preferably are constructed by conventional techniques. The straps 626, 628 of examples C–D are more rod or rope shaped and may be made of wire, plastic, rope, or the like, and preferably also are constructed by conventional techniques.

In addition, straps 622 and 626 of examples A and C are configured to surround a standard slat, to impede vertical movement beyond the height of the strap, as well as horizontal movement in a direction perpendicular to the major axis of the slat. Hence, unless a fastener connects strap 622 or 626 to the resiliently supported slat, the strap will not prevent horizontal movement of the slat in the direction parallel to the major axis of the slat. In contrast, straps 624 and 628 of examples B and D provide a narrower passage for the resiliently supported slat, requiring the resilient pad 620 and slat to be notched at the point of engagement with the respective strap. Thus, while the slats would require notching, they would no longer require that they be attached to the straps by a separate mechanical fastener, adhesive, or the like. With either type of strap, unless the strap is thin and flexible, it will be less likely to be suitable for use with floating end slats, for the reasons discussed above regarding the examples A, F and J–K of FIG. 16.

As to the resilient pad 620 to be used in combination with the straps of examples A–D, any one of many resilient materials and configurations may be suitable. Hence, FIG. 19 shows pad 620 as a solid block for simplified illustrative purposes. One of skill in the art will appreciate that alternative solid or non-solid configurations may be devised, just as there are multiple configurations in FIG. 16.

Figure 20:
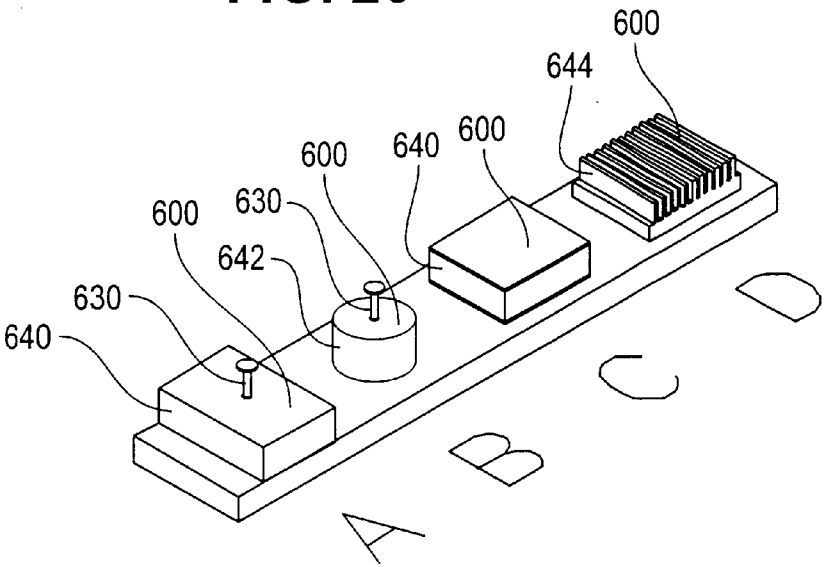
FIG. 20 is a perspective view of alternative exemplary floating slat supports 21A–D.

The examples A and B of FIG. 20 present the straight forward use of different resilient pads in conjunction with mechanical fasteners 630 that simultaneously engage the underlying and overlying slats, as well as the resilient pad, as discussed in relation to the simple resilient pads and fasteners used for illustrative purposes in FIGS. 2–6 and 8–15. Alternatively, examples C and D are shown with the intention of using an adhesive, such as applied in the form of liquid or double-sided tape, between the resilient pad and both an underlying and an overlying slat.

Also, by way of example, the resilient pad as illustrated in FIG. 20 may be a block of foam 640, such as depicted in examples A and C, a circular or donut shaped resilient structure 642, such as depicted in example B, or may be a fiber based pad 644, such as a piece of carpet, as depicted in example D. All of the resilient pads of examples A–D have an upward facing contact surface 600 to engage the underside of an overlying slat. It will be appreciated that the configurations of resilient supports shown in FIG. 20 present a compact structure, which makes them suitable for use in virtually any position in a floating slat frame.

Figure 21:
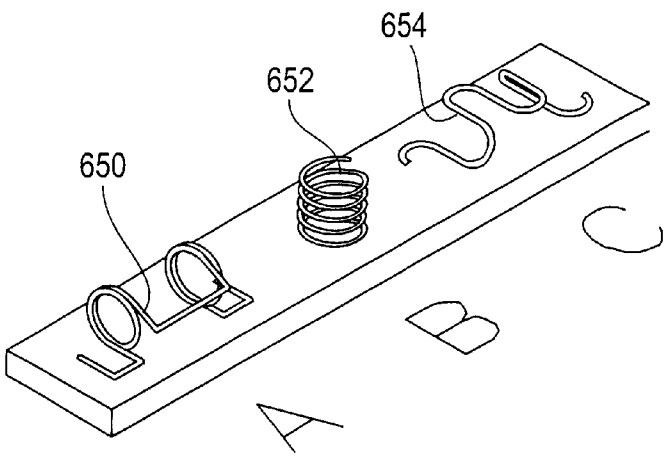
FIG. 21 is a perspective view of alternative exemplary floating slat supports 21A–C.

Finally, with respect examples A–C of FIG. 21, various wire forms including a simple torsion spring 650, coil spring 652 or sinusoidal spring 654 may be suitable to provide resilient support for floating slats. Supports constructed only of wire may be made via conventional techniques, and independently fastened to each of the slats, such as with staples, nails, or the like. Depending on the configuration chosen, a wire resilient support may be sufficiently compact for use in any position within a floating slat frame.

It should be understood that any of a variety of fastening means and suitable materials of construction and dimensions may be used to satisfy the particular needs and requirements of the end user. It also will be apparent to those skilled in the art that various modifications and variations can be made in the design and construction of floating slat frames without departing from the scope or spirit of the invention. Other embodiments of the invention will be apparent to those skilled in the art from consideration of the specification and practice of the invention disclosed herein.

What is claimed is:

1. A floating slat frame for use as base frame in a mattress foundation, said floating slat frame comprising a first plurality of spaced apart slats arranged in a first direction and in a first plane and at least a second plurality of spaced apart slats arranged in a second direction and in a second plane, said second direction being at an angle to said first direction and said second plane being spaced from said first plane, said frame further comprising at least one resilient support disposed between and directly engaging at least one of the slats of the first plurality and at least one of the slats of the second plurality, and comprising at least one slat of a third plurality of slats directly engaging at least two slats of said first plurality of slats and directly engaging at least one slat of said second plurality of slats.

2. A floating slat frame in accordance with claim 1, wherein the first plurality of slats are laterally spaced apart and parallel to each, and the second plurality of slats are longitudinally spaced apart and parallel to each other.

3. A floating slat frame in accordance with claim 1, wherein the first plurality of slats are longitudinally spaced apart and parallel to each, and the second plurality of slats are laterally spaced apart and parallel to each other.

4. A floating slat frame in accordance with claim 1, wherein said floating slat frame has first and second longitudinally spaced ends, and wherein located at each end of the floating slat frame is at least one slat of said third plurality of slats directly engaging at least two slats of said first plurality of slats and directly engaging at least one slat of said second plurality of slats.

5. A floating slat frame in accordance with claim 1, wherein said floating slat frame has first and second laterally spaced sides, and wherein located at each side of the floating slat frame is at least one slat engaging at least two slats of said first plurality of slats and engaging at least one slat of said second plurality of slats.

6. A method of providing resilient support in a mattress foundation base frame, comprising the steps of:

providing in a first plane and in a first direction a first plurality of spaced apart slats having an upper surface;

providing in a second plane spaced from said first plane and in a second direction at an angle to the first direction a second plurality of spaced apart slats having a lower surface;

providing at least one slat of a third plurality of slats directly engaging at least the upper surface of at least two slats of said first plurality of slats and directly engaging at least the lower surface of at least one slat of said second plurality of slats; and providing at least one resilient support disposed between and directly engaging at least said upper surface of at least one slat of said first plurality of slats and at least said lower surface of at least one slat of said second plurality of slats.

7. The method of claim 6, wherein the first plurality of slats are laterally spaced apart and parallel to each, and the second plurality of slats are longitudinally spaced apart and parallel to each other.

8. The method of claim 6, wherein the first plurality of slats are longitudinally spaced apart and parallel to each other, and the second plurality of slats are laterally spaced apart and parallel to each other.

9. The method of claim 6, wherein the base frame has first and second longitudinally spaced ends, and at least one slat of said third plurality of slats is directly engaging at least the upper surface of at least two of the first plurality of slats and directly engaging at least the lower surface of at least one slat of said second plurality of slats and is located at an end of the base frame.

10. The method of claim 6, wherein a connector directly engages at least two spaced apart slats of the second plurality of slats.

11. The method of claim 10, wherein the connector is relatively rigid and is fixedly attached to the at least two spaced apart slats of the second plurality of slats.

12. The method of claim 10, wherein the connector is relatively rigid and is hingedly attached to the at least two spaced apart slats of the second plurality of slats.

13. The method of claim 10, wherein the connector is flexible and is fixedly attached the at least two spaced apart slats of the second plurality of slats.

14. The method of claim 6, wherein a connector directly engages all of the spaced apart slats of the second plurality of slats.

15. A method of providing resilient support in a base frame of a mattress foundation base frame and core assembly combination, comprising the steps of:

providing in a first plane and in a first direction a first plurality of spaced apart slats having an upper surface;

providing in a second plane spaced from said first plane and in a second direction at an angle to the first direction a second plurality of spaced apart slats having a lower surface and an upper surface;

providing at least one slat of a third plurality of slats directly engaging at least the upper surface of at least two slats of said first plurality of slats and directly engaging at least the lower surface of at least one slat of said second plurality of slats;

providing at least one resilient support disposed between and directly engaging said upper surface of at least one slat of said first plurality of slats and said lower surface of at least one slat of said second plurality of slats; and attaching the core assembly to the upper surface of at least two slats of said second plurality of slats.

16. The method of claim 15, wherein the first plurality of slats are laterally spaced apart and parallel to each other and the second plurality of slats are longitudinally spaced apart and parallel to each other.

17. The method of claim 15, wherein the first plurality of slats are longitudinally spaced apart and parallel to each other, and the second plurality of slats are laterally spaced apart and parallel to each other.

18. The method of claim 15, wherein the base frame has first and second longitudinally spaced ends, and at least one slat of said third plurality of slats is directly engaging the upper surface of at least two slats of the first plurality of slats directly engaging at least the lower surface of at least one slat of said second plurality of slats and is located at an end of the base frame.

19. The method of claim 15, wherein a connector directly engages at least two spaced apart slats of the second plurality of slats.

20. The method of claim 19, wherein the connector is relatively rigid and is fixedly attached to the at least two spaced apart slats of the second plurality of slats.

21. The method of claim 19, wherein the connector is relatively rigid and is hingedly attached to the at least two spaced apart slats of the second plurality of slats.

22. The method of claim 19, wherein the connector is flexible and is fixedly attached to the at least two spaced apart slats of the second plurality of slats.

23. The method of claim 15, wherein a connector directly engages all of the spaced apart slats of the second plurality of slats.

* * * * *